US006164106A

United States Patent [19]

Nghiem et al.

[11] Patent Number: 6,164,106

[45] Date of Patent: Dec. 26, 2000

[54] PRESS APPARATUS

[75] Inventors: Xuan Luong Nghiem, Krefeld; Gert Lohmann, Neuss, both of Germany

[73] Assignee: Novopress GmbH Pressen und Presserkzeuge & Co. KG, Germany

[21] Appl. No.: 09/125,070

[22] PCT Filed: Feb. 6, 1997

[86] PCT No.: PCT/EP97/00533

§ 371 Date: Nov. 16, 1998

§ 102(e) Date: Nov. 16, 1998

[87] PCT Pub. No.: WO97/28929

PCT Pub. Date: Aug. 14, 1997

[30] Foreign Application Priority Data

Feb. 9, 1996 [DE] Germany ..... 296 02 240 U

[51] Int. Cl.[7] ..... H01R 43/042

[52] U.S. Cl. ..... 72/20.1; 72/31.01; 72/416; 29/720; 81/313

[58] Field of Search ..... 72/21.3, 20.1, 72/21.2, 31.01, 31.06, 3, 416; 29/720; 81/313

[56] References Cited

U.S. PATENT DOCUMENTS

| | | | |
|---|---|---|---|
| 2,882,766 | 4/1959 | Towler | 72/20.1 |
| 2,931,260 | 4/1960 | Townshend | 81/313 |
| 3,316,744 | 5/1967 | Spangler | 72/31.01 |
| 4,856,186 | 8/1989 | Yeomans | 29/720 |
| 4,936,126 | 6/1990 | Sato | 72/20.1 |
| 5,113,679 | 5/1992 | Ferraro | 72/31.01 |
| 5,168,736 | 12/1992 | Enneper | 72/21.3 |
| 5,280,716 | 1/1994 | Ryan | 81/313 |
| 5,323,697 | 6/1994 | Schrock | 72/402 |
| 5,490,406 | 2/1996 | College | 72/30.1 |

FOREIGN PATENT DOCUMENTS

| | | |
|---|---|---|
| 0451806 | 10/1991 | European Pat. Off. . |
| 0627273 | 7/1994 | European Pat. Off. . |
| 2389459 | 12/1978 | France . |
| 1940682 | 7/1971 | Germany . |
| 2214339 | 1/1976 | Germany . |
| 2136782 | 12/1982 | Germany . |
| 3423283 | 1/1986 | Germany . |
| 4040410 | 7/1991 | Germany . |
| 4240427 | 1/1994 | Germany . |
| 29502326 | 5/1995 | Germany . |
| 901091 | 7/1962 | United Kingdom . |
| 8707553 | 12/1987 | WIPO . |
| 9315880 | 8/1993 | WIPO . |
| 9419154 | 1/1994 | WIPO . |

OTHER PUBLICATIONS

PCT, WI 9601092, PCT/EP97/00533, Int'l. Filing Date Jun. 2, 1997—International Preliminary Exam.

German Pat Application, G 93 12 808.8, filed Aug. 26, 1993.

*Primary Examiner*—Daniel C. Crane

*Attorney, Agent, or Firm*—Liniak, Berenato, Longacre & White, LLC

[57] ABSTRACT

A pressing device (1, 111), in particular for joining a pipe (23) with a press fitting (24), has at least two pressing jaws (17, 18, 21, 22, 122, 123, 124, 125, 126) and a drive (7) for moving the pressing jaws (17, 18, 21, 22, 122, 123, 124, 125, 126) or a part thereof relative to one another from an open position into a final pressed position, such that at least one sensor (36, 37, 38, 39, 40, 41, 42, 51, 151, 152) for sensing the final pressed position of the pressing jaws (17, 18, 21, 22, 122, 123, 124, 125, 126) is arranged in the region of the pressing jaws (17, 18, 21, 22, 122, 126), and such that an indicating device (43), which generates an externally perceptible indicating signal when the final pressed position is or is not reached, is associated with the sensor (36, 37, 38, 39, 40, 41, 42, 51, 151, 152).

28 Claims, 15 Drawing Sheets

PRESS APPARATUS

This application is a 371 of PCT/EP97/00533, filed Feb. 6, 1997.

The invention concerns a pressing device, in particular for joining a pipe with a press fitting, having at least two pressing jaws and a drive for moving the pressing jaws or a part thereof relative to one another from an open position into a final pressed position.

It is known, in order to join pipes, to use sleeve-like press fittings that are made of plastic or metal. To produce a pipe joint, the press fitting is slid over the pipe ends and then radially compressed, both the press fitting and the pipe being plastically deformed. Pipe joints of this kind and the pertinent press fittings are known, for example, from DE-C-11 87 870 and EP-B-0 361 630.

Pressing of the press fitting and the pipe is accomplished with the aid of pressing devices such as are known in various embodiments, for example from DE-C-21 36 782, DE-A-34 23 283, EPA-0 451 806, EP-B-0 361 630, and DE-C-42 40 427. The pressing devices have at least two, and in some cases even more pressing jaws, at least a portion of which can be moved radially inward during the pressing operation to form a closed pressing space. A hydraulic piston, which can be acted upon by hydraulic pressure via a manually driven or electric motor-driven pump, is often provided as the drive to move the pressing jaws.

The pipe joints described above are produced, in particular, when installing water-carrying pipework in buildings. It is obviously extremely important that the press fitting and pipe ends be compressed so as to guarantee absolute tightness. The material deformation must therefore be uninterrupted over the circumference of the press fitting. To achieve this result, the pressing jaws are displaced until their respective opposing pairs of end faces come into contact, or at least until only a slight gap remains between said end faces.

To achieve this, the drive is displaced into its final position. The desired and predefined final pressed position of the pressing jaws is not necessarily, however, achieved thereby. The forces which occur lead to elastic deformations at the levers on which the pressing jaws sit or which are used to contract a pressing jaw ring. In addition, the pressing jaws, press fittings, and pipes are subject to tolerances which, if they add up unfavorably, mean that compression is insufficient when the final position of the drive is reached. In order nevertheless to be able to produce a leakproof pipe joint, the pressing jaws are acted upon by a pressing force which is designed, with the addition of a sufficient safety factor, so that in normal circumstances an adequate and therefore leakproof pressing is achieved.

Problems can nevertheless still occur, and result in an incomplete pressing. For example, it is difficult to maintain a constant final force for the drive. Achieving the final force is in most cases the responsibility of a release member acting as switching member, for example a torque coupling for rotating drives, a pressure relief valve for hydraulic devices, and an overcurrent release for electrically driven devices. Since the release member does not measure the drive force directly, but rather measures a converted magnitude (torque, pressure, or current) which represents only a fraction of the magnitude of the final force, any inaccuracy in the manufacture of the release member, and any wear, can have major effects on the final force of the drive and thus ultimately on pressing quality. The latter is also influenced by the ambient temperature and operating temperature. A particular difficulty is that the change in the final force, due primarily to wear, proceeds gradually, and therefore remains unnoticed by the control system.

A further reason for an incomplete pressing may lie in wear on the bearings for the transfer levers between the drive and the pressing jaws. This then causes an elongation of the pivot axes, with the result that in their final positions, the pressing jaws no longer constitute the desired contour, so that the predefined final pressed position is no longer reached. This again remains unnoticed by the control system.

Lastly, crushing of the press fitting can also occur if material or immovably adhering dirt gets into the gap between the respective opposing end faces of the pressing jaws. This prevents said gap from being closed all the way into the desired final pressed position despite the fact that the final force is reached in the drive. The result is then a defective pressing, with the result that tightness cannot be guaranteed.

It is therefore the object of the invention to configure a pressing device of the aforesaid kind in such a way that a substantially greater reliability can be achieved in the production of pipe joints.

According to the invention, this object is achieved in that at least one sensor for sensing the final pressed position of the pressing jaws is arranged on at least one pressing jaw; and an indicating device, which generates an externally perceptible indicating signal when the final pressed position is or is not reached, is associated with the sensor.

The principle of the invention consists in sensing the final pressed position of the pressing jaws substantially directly, i.e. at a point where falsification is practically ruled out, and then providing the operator, in a manner perceptible to him or her, with information as to whether the pressing jaws actually have or have not reached the final pressed position.

In its most general form, the information consists in the fact that, depending on or whether or not the pressing jaws have reached the final pressed position, the pressing device experiences a change in state that is perceptible to the operator. Direct sensing of the position of the pressing jaws, and the information based thereon, ensure that the operator knows whether or not the pressing was sufficient. If the operator ascertains that the final pressed position was not reached, for example because too low a drive force was generated or because wear occurred in the drive and/or in the transfer levers, the operator can repeat the pressing operation with a new pressing device.

With the approach as described above, the operator receives the information via an indicating signal. The indicating signal can be configured in any way, provided only that it makes perceptible a change in state at the indicating device. A visually perceptible indicating signal is particularly suitable for this purpose. An audibly perceptible indicating signal is also, of course, a possibility. If electrical current is available, the sensor can have a feeler which generates an electrical signal, and the indicating device can have a lamp which is electrically connected to the feeler. Instead, however, it is also possible to configure an indicating device so that it has a mechanical indicating member, which is coupled to the sensor in such a way that its position changes when the final pressed position is reached. The coupling can be purely mechanical or electromechanical.

According to a further feature of the invention, provision is made for the indicating device to have an indicating memory which maintains the indicating signal even after the pressing jaws have moved toward the open position, the indicating memory having an externally actuatable canceling device. The indicating signal is thus maintained, regardless of the indicating signal, until it is canceled by manual action. This ensures that the operator receives the information regarding pressing quality. It may be advantageous in this context that the canceling device has an actuation lock which can overridden only with a tool. The tool can then be in the possession of a person who is responsible for inspecting the pressing device.

The underlying principle of the invention can also be carried out by the fact that at least one sensor for sensing the final pressed position of the pressing jaws is arranged on at least one pressing jaw; and the sensor is coupled to the drive in such a way that the drive is automatically switched off by means of a shutdown device after the final pressed position is reached. With this embodiment of the principle, the operator receives the information as to whether the final pressed position has been reached via the fact that the drive is automatically shut down. If no automatic shutdown occurs, the operator knows that the pressing was not complete. The operator can then decide whether to continue or discontinue the pressing operation. The latter will be possible if the drive reached its final force. This embodiment of the principle of the invention can also be combined with the first embodiment, so that the operator additionally receives an indicating signal which informs him or her as to whether or not the final pressed position has been reached.

The underlying principle of the invention can also be carried out by the fact that at least one sensor for sensing the final pressed position of the pressing jaws is arranged on at least one pressing jaw; and the sensor is coupled to the drive via a locking device in such a way that the drive can no longer be activated, if it has been switched off during a pressing operation, unless the sensor or sensors has or have sensed the final pressed position.

In this instance the operator receives the information regarding the pressing quality only after the drive has shut down. If the drive can readily be started again, the operator can be certain that the pressing operation performed previously was correct, i.e. that the final pressed position was reached. Otherwise an attempt can be made to resume pressing, or—if this does not succeed—the pressing device must be replaced. This embodiment of the invention can once again be combined with the embodiments of the invention described above, so as to provide, in addition to the indication and/or the automatic drive control system, an additional guarantee against the continued use of a pressing device that is no longer suitable.

Prefferably, the locking device should have an externally actuatable unlocking device so that, if the reason for the mispressing does not lie in the pressing device itself, the pressing device can be used for the production of further pipe joints. To ensure that this capability is not misused by the operator in cases in which the reason for the mispressing lies in a deficiency of the pressing device itself, it is advantageous to configure the unlocking device in such a way that it can be actuated only with the use of a tool. The tool can be kept in a location where an inspection of the pressing device can be performed.

It is essential to the manner in which the invention achieves the object that the sensor senses the position of the respective pressing jaw substantially directly, i.e. without the interposition of levers or the like which connect the pressing jaws to the drive. For this purpose, the sensor can be arranged on a non-moving part of the pressing device in such a way that it senses the position of the respective associated pressing jaw, in particular its final pressed position. Alternatively thereto or in combination therewith, the sensor or one of the sensors can be arranged on one pressing jaw in such a way that it senses the position of the pressing jaw with respect to an adjacent pressing jaw. This can also be done by arranging the sensor or at least one of the sensors on two adjacent pressing jaws, in such a way that it senses the position of those pressing jaws relative to one another. This is preferably done so that the sensor or sensors is or are arranged in the region of the opposing end faces of two adjacent pressing jaws, so that the gap between said end faces is sensed. In many embodiments it is advantageous if several or all pairs of opposing end faces each have a respective sensor associated with them.

If multiple sensors are provided in order to sense the final pressed position of the pressing jaws, they should be coupled to one another so that they emit a signal only if all the sensors have sensed the final pressed position. In this context, the signal can be used for all three embodiments of the principle of the invention, i.e. to generate an indicating signal, to shut down the drive, and/or to hold open the locking device for the drive.

The basic principle of the invention can be applied to all pressing devices of the species cited initially. This also applies to an embodiment in which the pressing jaws sit on a pressing ring which has, in the region of an open closure point, coupling elements for the engagement of corresponding coupling elements of a closing device (cf. EP-A-0 627 273). The coupling elements on the pressing ring side can be moved together by means of the closing device to close the pressing ring, the sensor or at least one of the sensors being arranged in the region of the closing point and/or of the coupling elements on the closing device side. This latter arrangement is also one that is in the region of the pressing jaws as defined by the basic idea of the invention, if the coupling elements are in engagement.

A wide variety of embodiments is possible for the sensor, in this case particularly all known and desirably applicable sensors for sensing the position of the pressing jaws. In particular, the sensor can have a movably mounted feeler which coacts with a stop against which the feeler arrives as the pressing jaws are closed. In this context, the feeler can be attached to one pressing jaw and the stop to the adjacent pressing jaw, in order to sense their position relative to one another. The stop can be the end face, located opposite the feeler, of the pressing jaw itself. A separate stop, which is adjustable in the movement direction of the feeler so as to allow precise alignment, is nevertheless preferable. In an advantageous embodiment, the feeler is coupled to a sensor which senses the positional change of the feeler. All sensors based on the principles of induction, eddy current, capacitance, magnetism, or resistance are possible here. Optical sensors, for example in the form of photoelectric barriers, are also possible, however. Pressure sensors or travel sensors can also be used.

Even if the feeler is arranged on the pressing jaw itself, it is possible to arrange the sensor outside the pressing jaws if the feeler has a corresponding extension. This has the advantage that any electrical lines remain on the part that is fixed to the unit, thus facilitating, for example, replacement of pressing jaws.

A fourth embodiment of the basic principle of the invention consists in providing, in the region of the pressing jaws, at least one locking device which, after the pressing operation has been initiated, prevents the pressing jaws from being opened back to the open position until the final pressed position has been reached. In this case the operator can recognize, based on whether or not the pressing device can be completely opened again after the pressing, whether the pressing quality was sufficient, i.e. whether the final pressed position of the pressing jaws was reached. In this context, the locking device is preferably mechanically configured, since this guarantees a high level of reliability. Electrically operating locking devices are also possible, however; the lock itself can be implemented by means of an electrically actuated interlock. It is understood that this means of achieving the object can also be combined with the other three embodiments of the principle of the invention in order to improve protection against continued use of a pressing device that is no longer working properly.

The locking device preferably has an externally actuatable unlocking device so that the pressing device can be removed from the pressing point if the pressing jaws cannot, upon further pressing attempts, be moved into the final pressed position. This eliminates any disassembly of the pressing device. Here again, it is disadvantageous that the unlocking device cannot easily be activated manually, but rather that a tool is needed for the purpose. By having the tool in the possession of another person, this ensures that a "two-heads" inspection will be performed.

The locking device(s) should each be attached to two adjacent pressing jaws, preferably in the region of two opposing end faces.

The locking device can be configured in many ways. One possible mechanical solution is characterized in that the locking device has on the one side a locking member and on the other side a guide device into which the locking member engages, the locking member and/or guide device having locking elements which constitute a return lockout acting only in the opening direction, and the guide device having a diverting device which the locking member reaches only if the pressing jaws are in the final pressed position, and which then deflects the locking member into a return track which bypasses the return lockout. This locking device principle can be carried out in many ways. It offers a high level of security that the pressing device can be opened completely only if the pressing jaws have been moved into the final pressed position.

The invention is illustrated in more detail with reference to exemplifying embodiments in the drawings, in which:

FIGS. 3A and 3B show a front view of the pressing device according to FIGS. 1 and 2 in the almost-closed position, with improper crushing of the press fitting wherein FIG. 3B is a detail view of a portion of FIG. 3A;

FIGS. 4A and 4B show a front view of the pressing device according to FIGS. 1 and 2, in an improperly closed position wherein FIG. 4B is a detail view of a portion of FIG. 4A;

In the Figures, identical parts or those of identical function are labeled with the same reference characters in the various embodiments.

Figure 1:
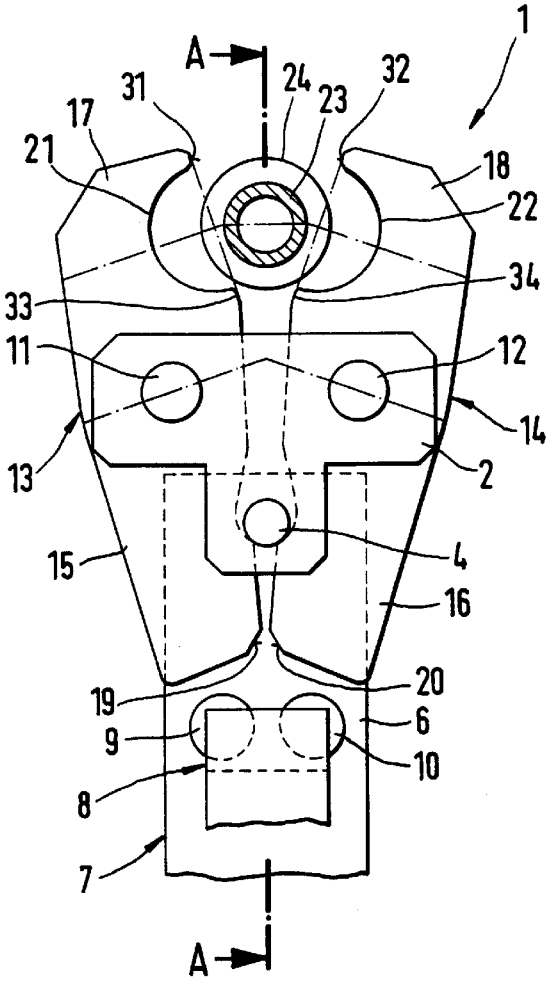
FIG. 1 shows a known pressing device in a front view, with press fitting and pipe end, in the open position.

Pressing device 1 depicted in FIGS. 1 through 4B has two T-shaped bearing plates 2, 3 which are arranged, when viewed from the front, exactly one behind another. A connecting pin 4 passes through the lower part of bearing plates 2, 3. Placed on said connecting pin 4 from both sides are support plates 5, 6 (front support plate 5 is omitted from FIGS. 1, 3A, 3B, 4A and 4B), which belong to the drive labeled in its entirety as 7. Only their upper portion is depicted. Secured to their lower ends is a hydraulic cylinder (not depicted here), from which a piston rod projects upward. The upper end of the piston rod is equipped with a drive head 8 that is configured in a fork shape at the top. Inside drive head 8, two drive rolls 9, 10 are mounted next to one another, freely rotatably about a horizontal axis. By means of the hydraulic cylinder, drive head 8 can be moved vertically in the direction of arrow F (and, of course, also moved back). Connecting pin 4 is of removable design, so that the entire drive 7 can easily be taken out.

In the upper region, bearing pins 11, 12, arranged at a distance next to one another, pass through bearing plates 2, 3. A pivot lever 13, 13 is mounted on each of bearing pins 11, 12 between bearing plates 2, 3. The two pivot levers 13, 14 are configured in mirror-symmetrical fashion. They have drive arms 15, 16 proceeding downward from bearing pins 11, 12, and jaw arms 17, 18 proceeding upward. Drive arms 15, 16 have drive surfaces 19, 20 which are initially only slightly inclined from the horizontal, and then transition into a region oriented steeply upward. Semicircular recesses which constitute the contour of pressing jaws 21, 22 are shaped into the sides of jaw arms 17, 18 located opposite one another.

Figure 2:
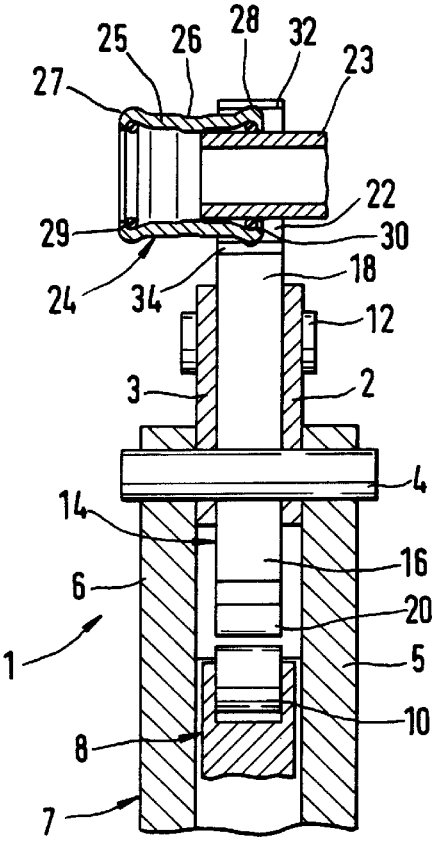
FIG. 2 shows a cross section through the pressing device according to FIG. 1, in plane A—A.
Figure 3A:
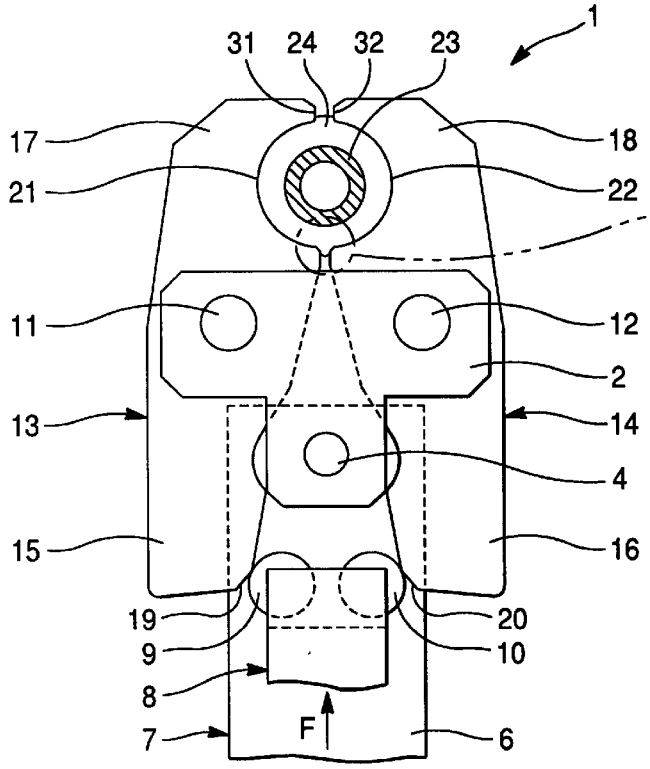
Figure 3B:
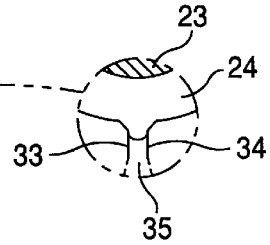

FIG. 1 and 2 show pressing device 1 in the open position, in which drive head 8 assumes its lowest position in which it is not resting against drive arms 15, 16. Pressing device 1 is placed on a pipe joint so that it lies between pressing jaws 21, 22. The pipe joint has a pipe end region 23 over which a press fitting 24 is partially slid. This is particularly evident from FIG. 2. Press fitting 24 has a cylindrical section 25 having a centrally located constriction 26 which acts as a stop for pipe end region 23. At the free ends, press fitting 24 has outwardly bulging annular beads 27, 28 into the inside of each of which an elastomeric sealing ring 29, 30 is set. Pressing jaws 21, 22 are located at the level of right-hand annular bead 28 in FIG. 2.

For the pressing operation, the hydraulic cylinder (not depicted) is acted upon by hydraulic pressure via a corresponding pump so that the piston rod, together with drive head 8 mounted thereon, travels upward in the direction of arrow F (FIGS. 3A, 3B, 4A and 4B). Drive rolls 9, 10 thereby initially come into contact against the shallowly inclined sections of drive surfaces 19, 20. As upward travel continues, drive arms 15, 16 are spread apart, the result of which is that jaw arms 17, 18 approach one another and pressing jaws 21, 22 come into contact against annular bead 28. As drive head 8 continues to move upward, the actual pressing operation begins, in which annular bead 28 and the immediately adjoining region of cylindrical section 25 are plastically deformed radially inward, pipe end region 23 also being plastically deformed radially inward in the last stage of pressing. In this context, drive rolls 9, 10—as visible from FIGS. 3A, 3B, 4A and 4B—travel into the region between drive arms 15, 16 where drive surfaces 19, 20 are now at a very acute angle, i.e. are inclined very steeply with respect to one another.

FIGS. 3A, 3B, 4A and 4B depict incorrect closing positions and the reasons for them; in both cases, complete pressing does not occur because pressing jaws 21, 22 do not reach their final pressed position. In the situation depicted in FIGS. 3A and 3B, material of annular bead 28 has been squeezed between the respective opposing pairs of end faces 31, 32 and 33, 34, as is evident in particular from the detail enlargement in the region of the lower pair of end faces 33, 34. This material prevents further pressing of press fitting 24, and does so (as shown by the position of drive head 8) at an early point in time. The amount of pressing is so small that the connection between pipe end region 23 and press fitting 24 is not sealed, i.e. is defective, even though drive 7 has exerted its maximum force.

Figure 4A:
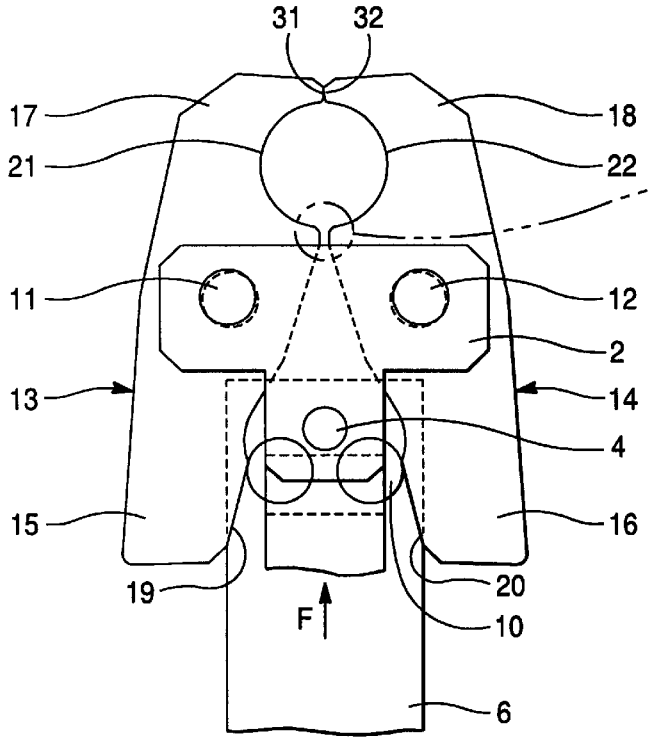
Figure 4B:
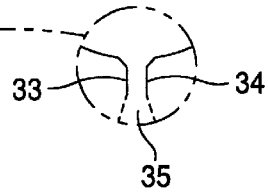

The situation according to FIGS. 4A and 4B shows the position of pressing jaws 21, 22—in this case without a pipe joint—when wear has occurred on bearing pins 11, 12 so that they exhibit an impermissible level of play. In the unloaded state (FIGS. 1 and 2), bearing pins 11, 12 assume the position drawn with dotted lines. When pressing jaws 21, 22 are moved toward one another as drive head 8 is moved upward, the center points of bearing pins 11, 12 are displaced outward, within the existing play and as a reaction to the forces thereby occurring, into the position drawn with solid lines. The result is that although pressing jaws 21, 22 come into contact with their upper end faces 31, 32, a gap 35 remains in the region of lower end faces 33, 34, as is particularly clear from the detail enlargement. This gap can reach a dimension such that in a pressing operation, insufficient pressing of press fitting 24 will occur in this region, so that the pipe connection is not tight in this region.

Both types of mispressing, which can also result from different wear causes, are generally not noticed, or are noticed only after a number of mispressings have already been performed. To prevent this from happening, additional devices which will be evident from the Figures described below are provided according to the invention. In most cases, for reasons of clarity, drive 7 has in this context been taken off after removal of connecting pin 4. In addition, pressing jaws 21, 22 here are not shaped like segments of a circle, but rather are hexagonal in shape when closed. This is immaterial to the function of the additional devices, however, i.e. the latter are suitable for any desired contour of pressing jaws 21, 22.

In the exemplifying embodiment of FIGS. 5 through 8, a guide block 36, in which a feeler pin 37 is guided in axially movable fashion, is attached to left-hand jaw arm 17 at the level of lower end faces 33, 34. In a region of enlarged diameter, feeler pin 37 has two annular flanges 38, 39 arranged at a distance from one another, which leave an annular groove 40 between them. Left-hand annular flange 38 is acted upon, on the side facing away from annular groove 40, by a compression spring 41 which braces against a cover 42. With pivot levers 13, 14 in the open position shown in FIGS. 5 and 6, right-hand annular flange 39 rests against a stop in guide block 36. Above annular flanges 38, 39 and annular groove 40, an indicating pin 43 is arranged in a corresponding cylindrical channel. Indicating pin 43 has at the lower end an annular collar 44 which is acted upon in the direction of annular groove 40 by a compression spring. Indicating pin 43 projects outward from guide block 36 and is movable axially perpendicular to feeler pin 37. At the outer end, indicating pin 43 has a further annular collar 46 with which it can be grasped manually.

Arranged in stationary fashion in the region of the right-hand end surface 34 of pressing jaw 22 is a stop block 48. It corresponds to feeler pin 37 such that as pressing jaws 21, 22 close, feeler pin 37 arrives against stop block 48.

Figure 5:
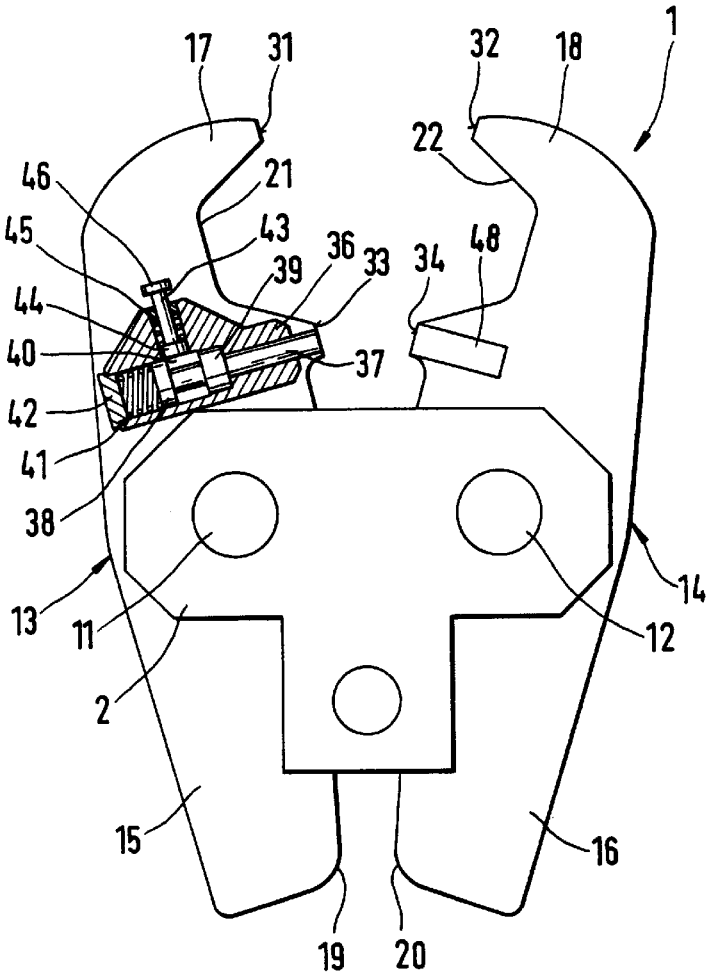
FIG. 5 shows a front view of a portion of a pressing device having a mechanical indicating device, in the open position.
Figure 6:
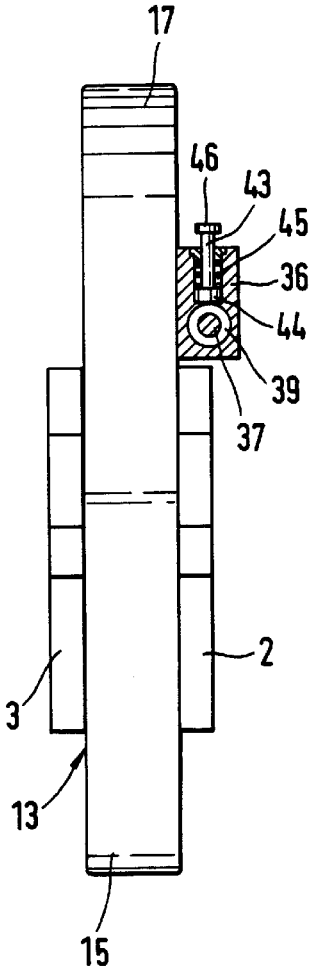
FIG. 6 shows the pressing device according to FIG. 5 in a side view.
Figure 7:
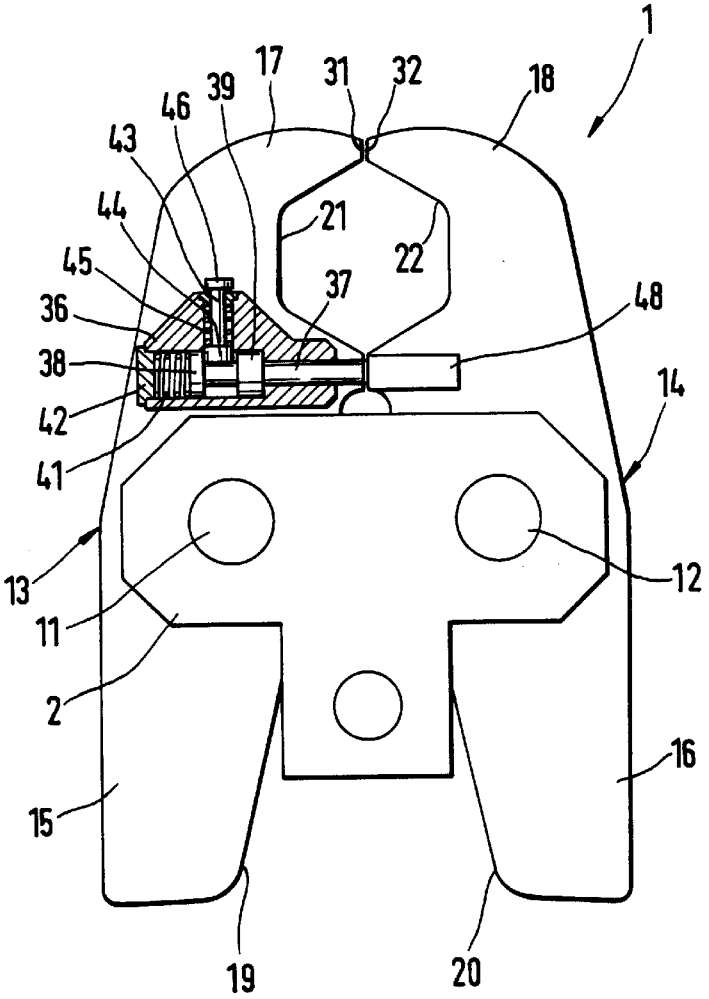
FIG. 7 shows a front view of the pressing device according to FIGS. 5 and 6 in the final pressed position.
Figure 8:
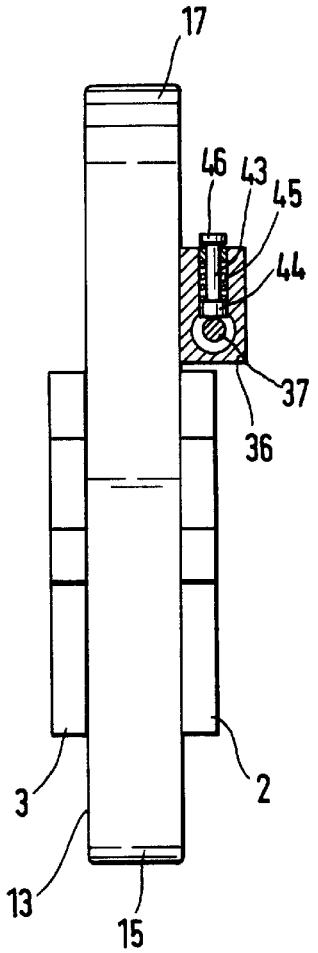
FIG. 8 shows the pressing device according to FIG. 7 in a side view.

Annular flanges 38, 39 on feeler pin 37 are arranged so that the axial extension of annular groove 40 is somewhat greater than the diameter of lower annular collar 44 of indicating pin 43. In the open position (FIGS. 5 and 6), annular collar 44 rests with its underside on left-hand annular flange 38, so that it cannot drop into annular groove 40. In this position, feeler pin projects the farthest out of guide block 36. During the pressing operation, pressing jaws 21, 22 pivot with respect to one another in the closing direction (FIGS. 7 and 8). Shortly before the final pressed position is reached, the projecting end of feeler pin 37 comes into contact against stop block 48. As pressing jaws 21, 22 move farther in the closing direction, feeler pin 37 is pushed into guide block 36, with the result that annular flange 38 supporting indicating pin 43 is also displaced. This continues until annular flange 38 slips out of the region of annular collar 44, and indicating pin 43, with annular collar 44, drops into annular groove 40. In this context, the individual parts are configured so that this cannot occur until pressing jaws 21, 22—as shown in FIGS. 7 and 8—have reached their final pressed position, thus ensuring that the pressing is correct. Since indicating pin 43 projects only slightly out of guide block 36, the operator can see immediately whether pressing jaws 21, 22 have actually reached the final pressed position, or whether an incomplete pressing has occurred. In the latter case, indicating pin 43 would remain in the initial position as shown in FIGS. 5 and 6.

After pressing device 1 has been removed from the pipe joint, indicating pin 43 is once again pulled out against the action of compression spring 45. This releases feeler pin 37, so that it is pushed by compression spring 41 back toward the opposing end face 34 against the internal stop. Pressing device 1 is then ready for another pressing operation.

Figure 9:
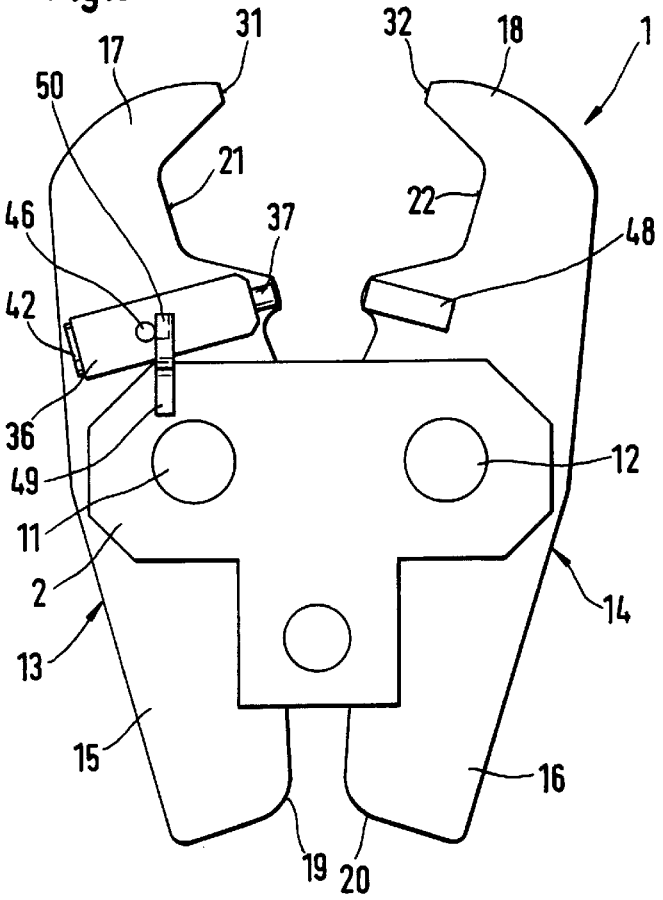
FIG. 9 shows a front view of a portion of a pressing device having a modified indicating device, in the open position.
Figure 11:
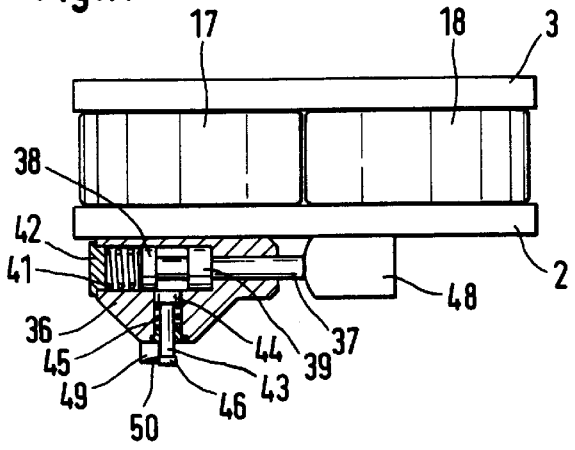
FIG. 11 shows a plan view of the pressing device according to FIGS. 9 and 10 in a closed position.

In the exemplifying embodiment as shown in FIGS. 9 and 11, guide block 36 is rotated 90 degrees so that indicating pin 43 projects horizontally. Otherwise no modifications have been made.

Additionally, however, there is secured to bearing plate 2 a Z-shaped locking bracket 49 whose free limb 50 engages in the movement region of indicating pin 43 when the latter is in the position pulled out of guide block 36. This position is visible in FIGS. 9 and 10. The outer annular collar 46 of indicating pin 43 is then located directly in front of limb 50 of locking bracket 49.

Figure 10:
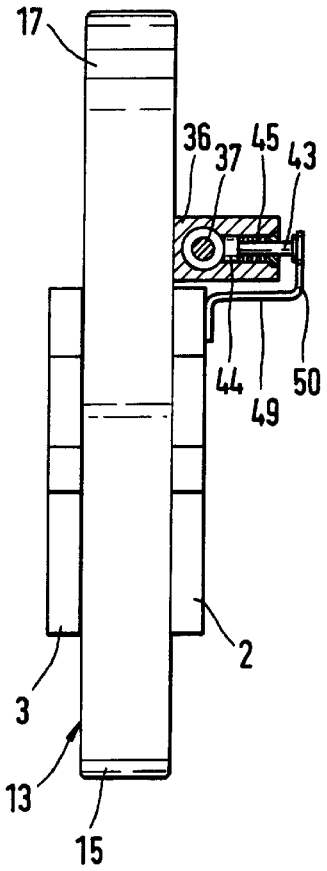
FIG. 10 shows a side view of the pressing device according to FIG. 9.

When the pressing operation is initiated, starting from the open position visible in FIGS. 9 and 10, annular collar 56 is moved against limb 50. Since the latter is of bendable configuration and is also—as is evident from FIG. 11—wedge-shaped on the side facing guide block 36, limb 50 is bent by annular collar 46 away from guide block 36, so that indicating pin 43 can move past locking bracket 49. Subsequent pressing is accomplished in the manner already described with reference to the exemplifying embodiment shown in FIGS. 5 through 8. Pressing jaws 21, 22 can readily be opened when they have reached their final pressed position. In this case indicating pin 43 with its annular collar 44 has moved into annular groove 40, and projects only slightly from guide block 46. It therefore does not collide with limb 50 of locking bracket 49 upon opening. If the pressing was incomplete, however, because pressing jaws 21, 22 did not reach the final pressed positions, and if indicating pin 43 has thus retained its initial position (FIG. 11), left-hand pressing jaw 21 can no longer pivot into its initial position since limb 50 is acting as a lock for indicating pin 43. A manual intervention is then necessary, either to bend locking bracket 49 aside or to push feeler pin 37 in sufficiently for indicating pin 43 to drop into annular groove 40. In this case, therefore, the visual indication by way of indicating pin 43 is combined with a locking device which allows pressing jaws 21, 22 to be opened into the open position only if either the final pressed position has been reached, or the locking effect of the locking device has been overridden by manual intervention.

Figure 12:
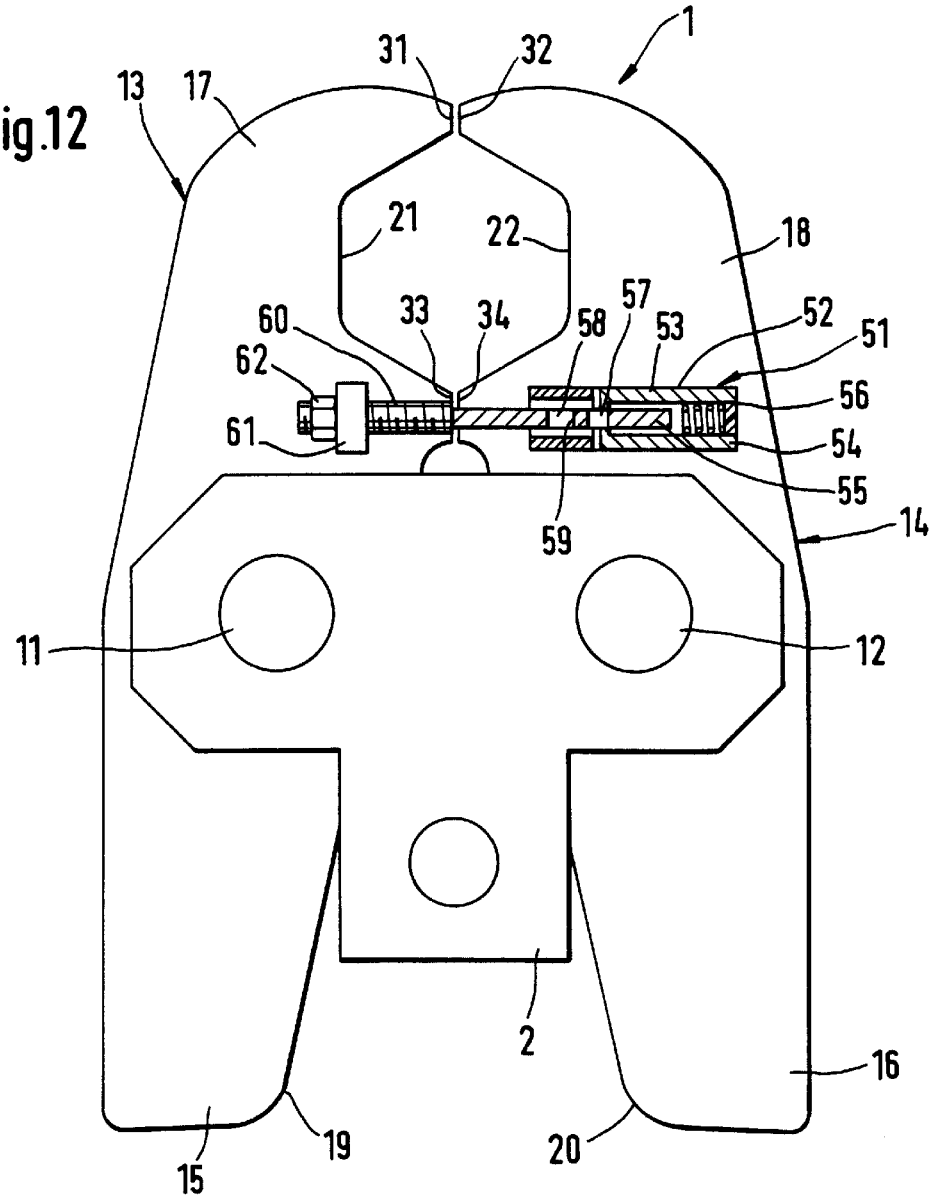
FIG. 12 shows a front view of a portion of a pressing device having an electrical sensor.
Figure 13:
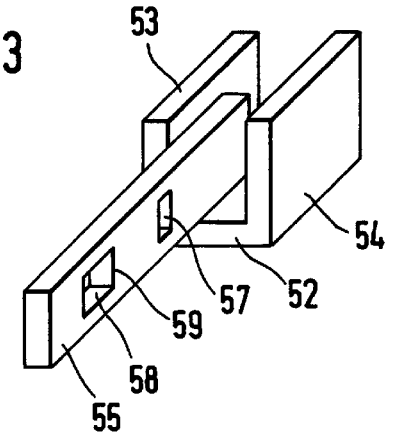
FIG. 13 shows a partial perspective depiction of a sensor according to FIG. 12.

In the exemplifying embodiment according to FIGS. 12 and 13, a clearance sensor device 51 operating on the eddy-current principle is attached to right-hand jaw arm 18 at the level of the lower pair of end faces 33, 34. Said device has a coil bar 52 that is U-shaped in cross section, into each of whose U-arms 53, 54 an electrical coil is incorporated, in opposing fashion (not depicted). Coil bar 52 extends horizontally toward the opposing end face 33, in which a feeler plate 55 is guided displaceably in the longitudinal direction. It projects out of coil bar 52 toward the opposing end face 33. Arranged in coil bar 52 on the side facing away from end face 33 is a compression spring 56 which attempts to move feeler plate 55 toward end face 33.

Feeler plate 55 has a reference slot 57 whose extension in the axial direction of feeler plate 55 is on the same order as the smallest gap that may be expected between end faces 33, 34 in the event of a mispressing, i.e. if the final pressed position is not reached. In the direction toward the pair of end faces 33, 34, feeler plate 55 has, spaced away from reference slot 57, a window 58 whose side adjacent to reference slot 57 constitutes a measurement edge 59.

Located on left-hand jaw arm 17, opposite feeler plate 55, is a stop pin 60 which is threaded into a retaining block 61 secured to jaw arm 17. Stop pin 60 can be axially adjusted via the threads in the through hole of retaining block 61 and on stop pin 60. Once the position has been found, it can then be immobilized with a locknut 62.

With pivot levers 13, 14 in the open position (not depicted here), feeler plate is extended well out, and projects beyond the adjacent end face 34. During the pressing operation, feeler plate 55 comes in contact against stop pin 60 in a specific position and is pushed into guide housing 52 as pressing continues. Reference slot 57 thereby initially moves past the eddy-current coils, with the consequence that the damping resulting from feeler plate 55 is abolished and a signal amplitude is created which is taken as a reference. As feeler plate 55 is pushed farther in, a damping then occurs again because of the material of feeler plate 55 between reference slot 57 and window 58. As pressing is continued, measurement edge 59 then also arrives in the region of the eddy-current coils, so that the damping decreases again.

With pressing jaws 21, 22 in the closed position achieved at the completion of pressing, the amplitude generated by reference slot 57 is compared with the amplitude effected by measurement edge 59. If the quantitative difference between the two amplitudes exceeds a predefined value, feeler plate 55 was not pushed far enough into coil bar 52, i.e. pressing jaws 21, 22 did not reach their final pressed position. In this case a signal can be generated that is made visually perceptible, for example in the form of a lamp. This indicates to the operator that the pressing was incomplete. No visible indication is then given if the pressing was correct, so that the absence of a visible indication gives the operator the information that pressing jaws 21, 22 have reached their final pressed position. The signal state described above can be stored, so that any visual indication can be canceled only by manual intervention. This can be made even more difficult—thus prompting an inspection—if the indication can be canceled only by using a specific tool (special key). It is also possible, of course, to configure the circuit conversely, so that a visible indication is given only when the final pressed position is reached. If no such indication is given, the operator knows that a mispressing occurred.

The result of the comparison of damping amplitudes can also be used for other purposes, in order to prevent the operator from performing additional mispressings for an even longer period. For example, in the event of an incomplete pressing, a signal can be given to a locking device for drive 7 which makes it impossible for drive 7 to start again.

Provision can be made, in this context, for the locking device to be unlockable by manual intervention. In this context, unlocking can also be made more difficult by making it possible only with the aid of a special tool.

Figure 14:
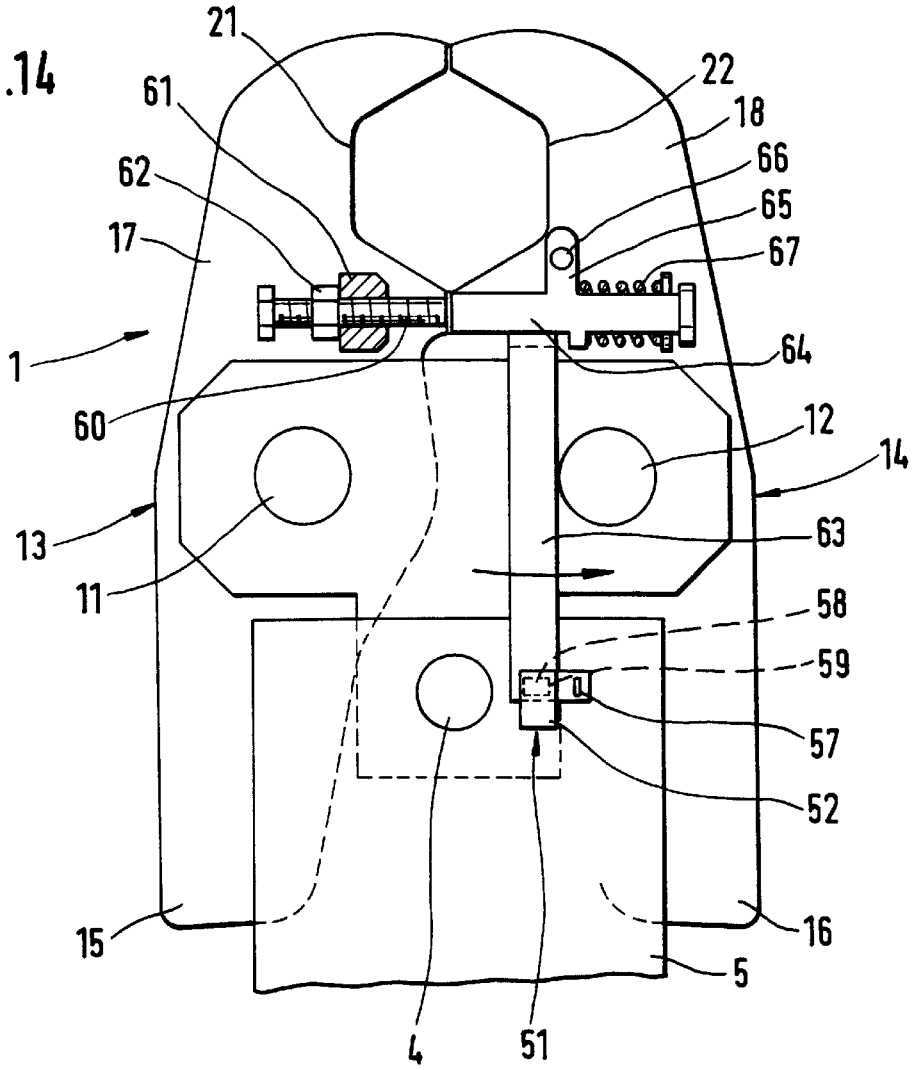
FIG. 14 shows a front view of a portion of a pressing device having a different electrical sensor.
Figure 15:
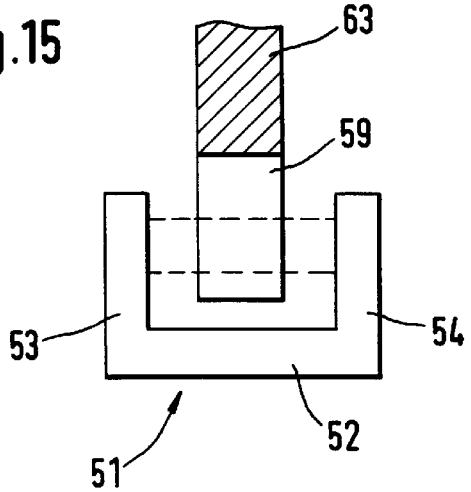
FIG. 15 shows a partial depiction of the sensor according to FIG. 14.
Figure 16:
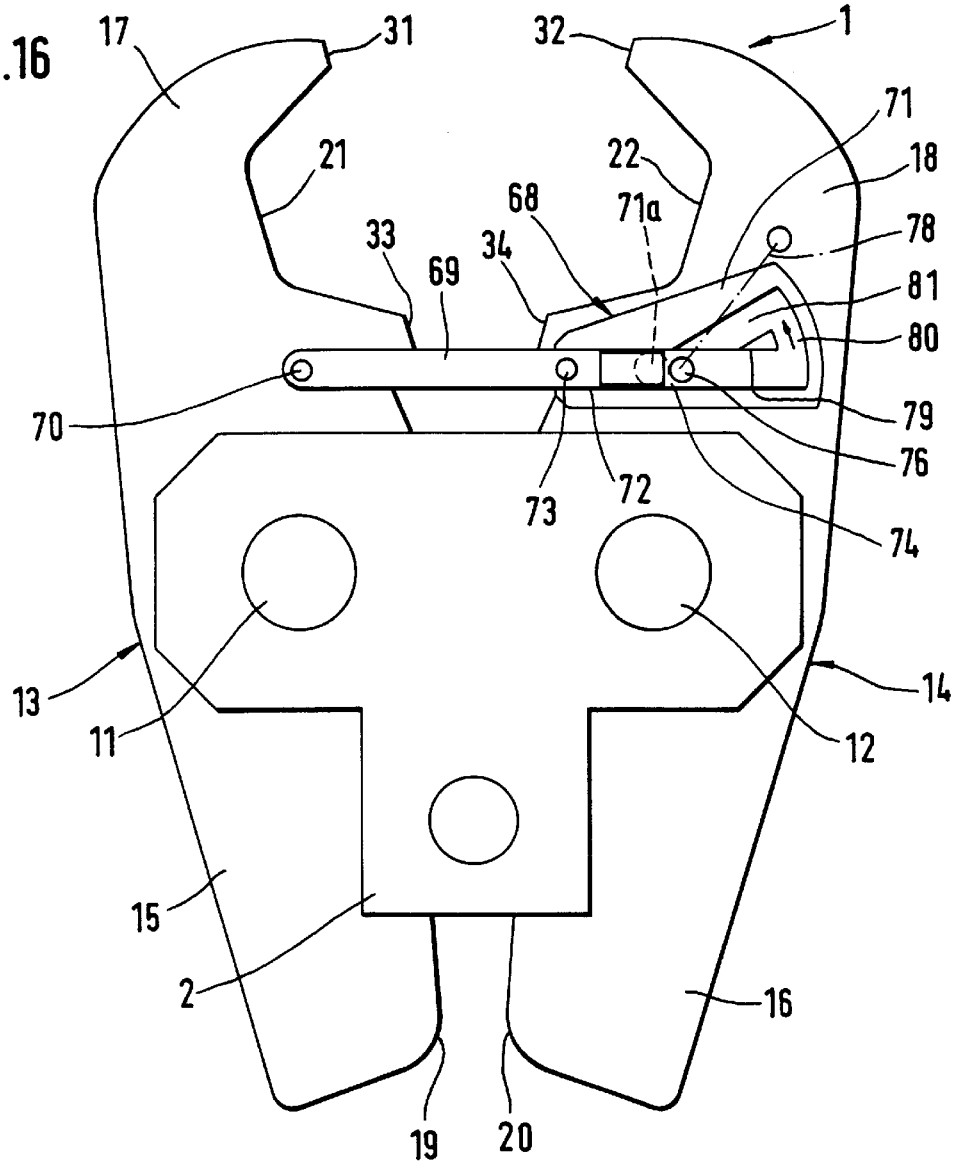
FIG. 16 shows a front view of a portion of a pressing device having a mechanical locking device, in the open position.
Figure 17:
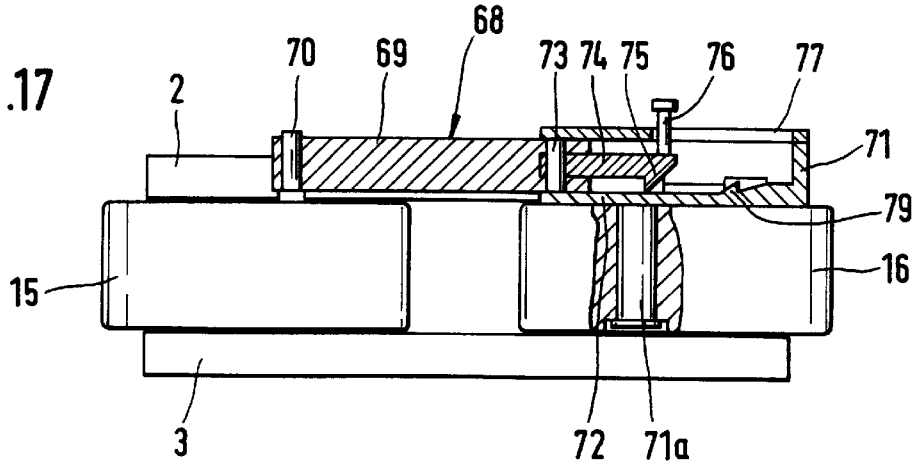
FIG. 17 shows a view from below of the pressing device according to FIG. 16, with a partial sectioned depiction through the locking device.

In the exemplifying embodiment shown in FIGS. 14 and 15, a clearance sensor 51 operating on the eddy-current principle is also used, its coil bar 52, U-shaped in cross section, again being secured to the outer side of support plate 5 of drive 7. The lower end of a transfer lever 63 projects into coil bar 52, transfer lever 63 once again having, in the region of coil bar 52, a reference slot 57 and a window 58 arranged at a distance from one another.

The upper end of transfer lever 63 is secured to a feeler pin 64 which is suspended, pivotably about a horizontal axis, on a bearing pin 66 via a tab 65. In its outer portion, the feeler pin is surrounded by a compression spring 67 which attempts to pivot feeler pin 64 clockwise. Located once again on the left side is a stop pin 60 which is retained in a manner analogous to the exemplifying embodiment illustrated by FIGS. 12 and 13.

With pressing jaws 21, 22 in the open position (not depicted), feeler pin 64 is pivoted clockwise sufficiently that it projects beyond end surface 34, and so that reference slot 57 is located on the left side of the eddy-current coils in coil bar 52. When pressing occurs, the end face of feeler pin 64 comes into contact against stop pin 60. Further pressing causes a counterclockwise pivoting of feeler pin 64, so that first of all reference slot 57 moves past the coils in coil bar 52 and thus generates a reference signal, and as the operation proceeds, window 58 of measurement edge 59 comes into the influence region of the eddy-current coils. The comparison of damping amplitudes already described with reference to the exemplifying embodiment according to FIGS. 12 and 13 can then be performed; the possibilities described there for using a signal depending on the particular closed position can be utilized again here.

Figure 21:
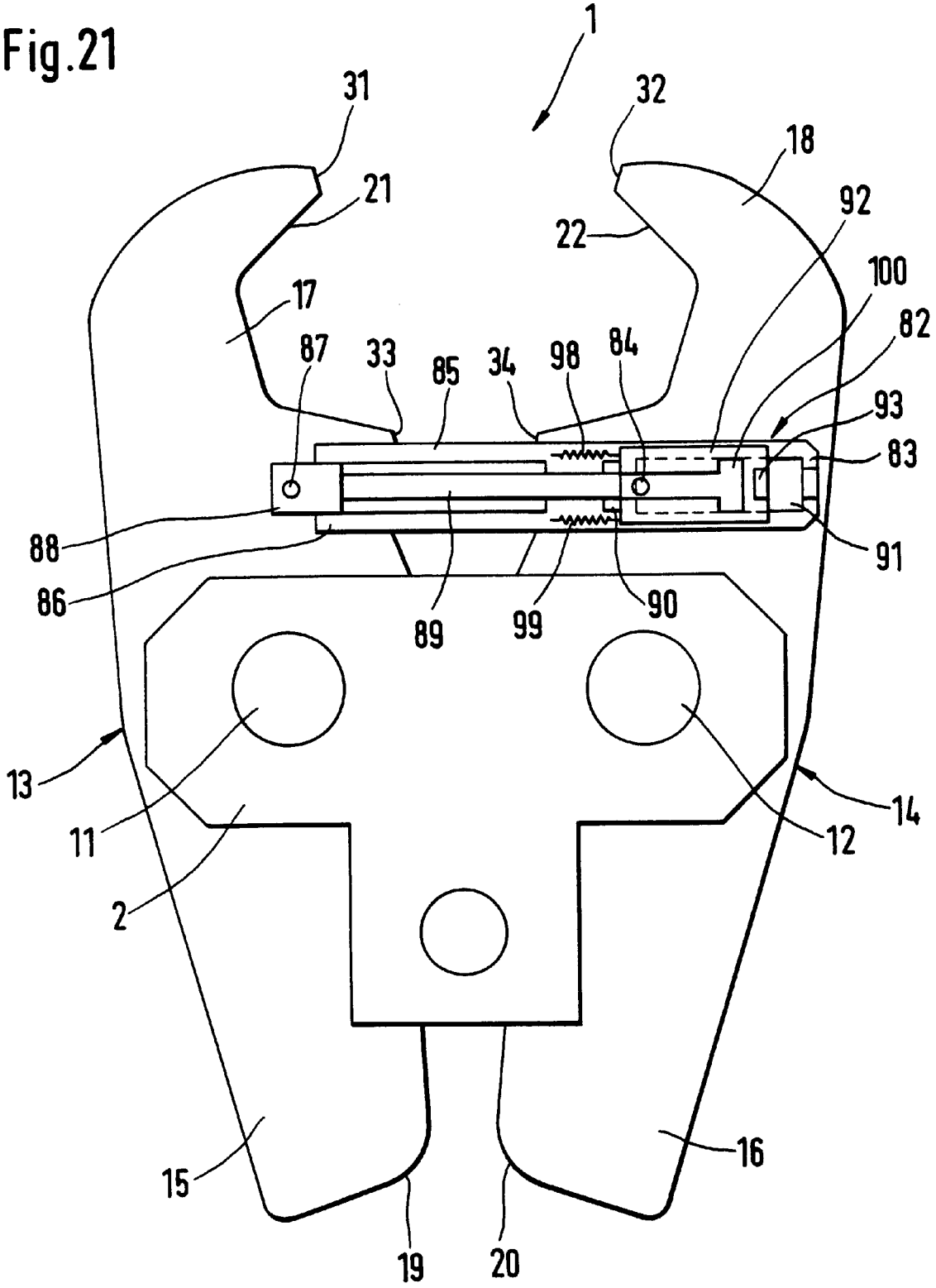
FIG. 21 shows a front view of a portion of a pressing device with a different mechanical locking device, in the open position.
Figure 31:
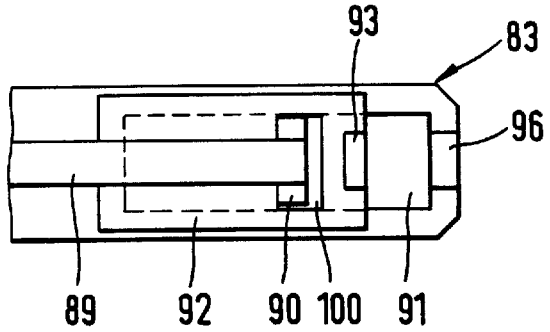
FIG. 31 shows a plan view of the locking device according to FIG. 30.

The two exemplifying embodiments according to FIGS. 17 through 20 on the one hand, and FIGS. 21 and 31, share the feature that the additional device for ensuring that the pressing jaws 21, 22 reach their final pressed position are configured as locking devices which allow pressing jaws 21, 22 to be opened without manual intervention only if pressing jaws 21, 22 have first reached their intended final pressing position.

In the exemplifying embodiment according to FIGS. 16 through 20, a locking device 68 is provided, part of which is a catch strut 69 that is suspended, pivotably about a horizontal axis 70, on left-hand jaw arm 17 at the level of the lower pair of end faces 33, 34. Catch strut 69 projects into a lock housing 71 which is mounted on jaw arm 18, pivotably about a horizontal axis 71*a*. Catch strut 69 is displaceably guided in lock housing 71 in a guideway 72. At that end, a catch 74 having a downwardly projecting catch tooth 75 is mounted, pivotably about a horizontal axis, via a pivot pin 73. Attached at the top of the free end of catch 74 is an actuation pin 76 which projects out of lock housing 71 through an opening 77 provided there. Catch 74 is of bendable configuration, so that its free end can be bent away from guideway 72, toward opening 77, by actuation pin 76. Also secured to actuation pin 76 is a tension spring 78 (indicated only schematically with dot-dash lines), the other end of which is attached to jaw arm 18.

Guideway 72 is of straight configuration, and has in its end region a catch step 79. Guideway 72 is raised at the end, and transitions into a curved diversion track 80 proceeding at right angles from it. From this, a return track 81 proceeds obliquely back toward guideway 72; in addition, return track 81 is not milled in as deeply as guideway 72.

Figure 18:
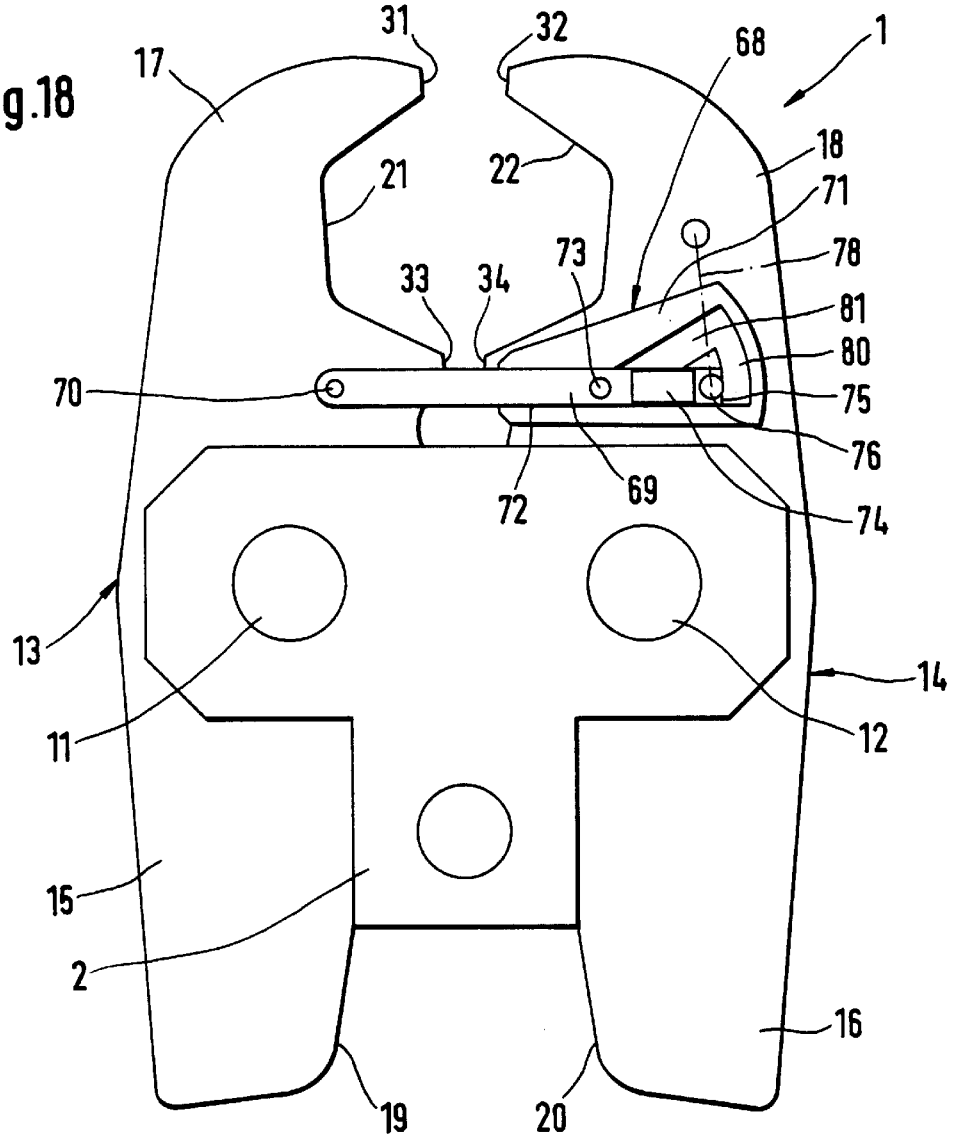
FIG. 18 shows a front view of the pressing device according to FIGS. 16 and 17, in a partially closed position.
Figure 19:
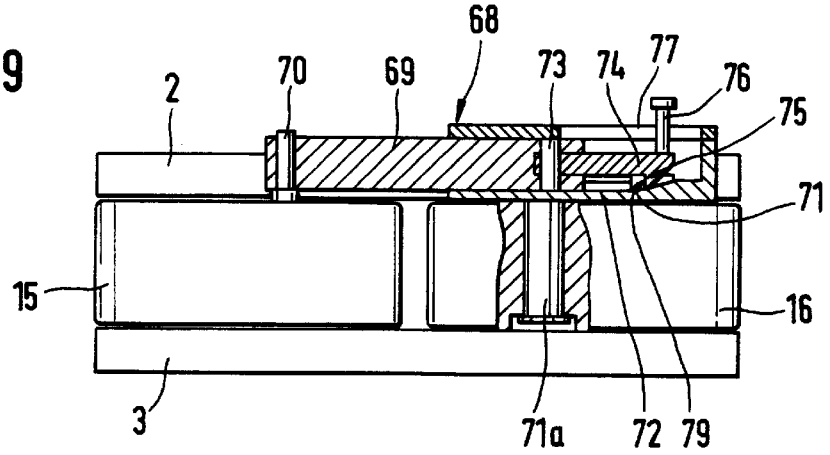
FIG. 19 shows a view from below of the pressing device according to FIG. 18, with a partial sectioned depiction through the locking device.
Figure 20:
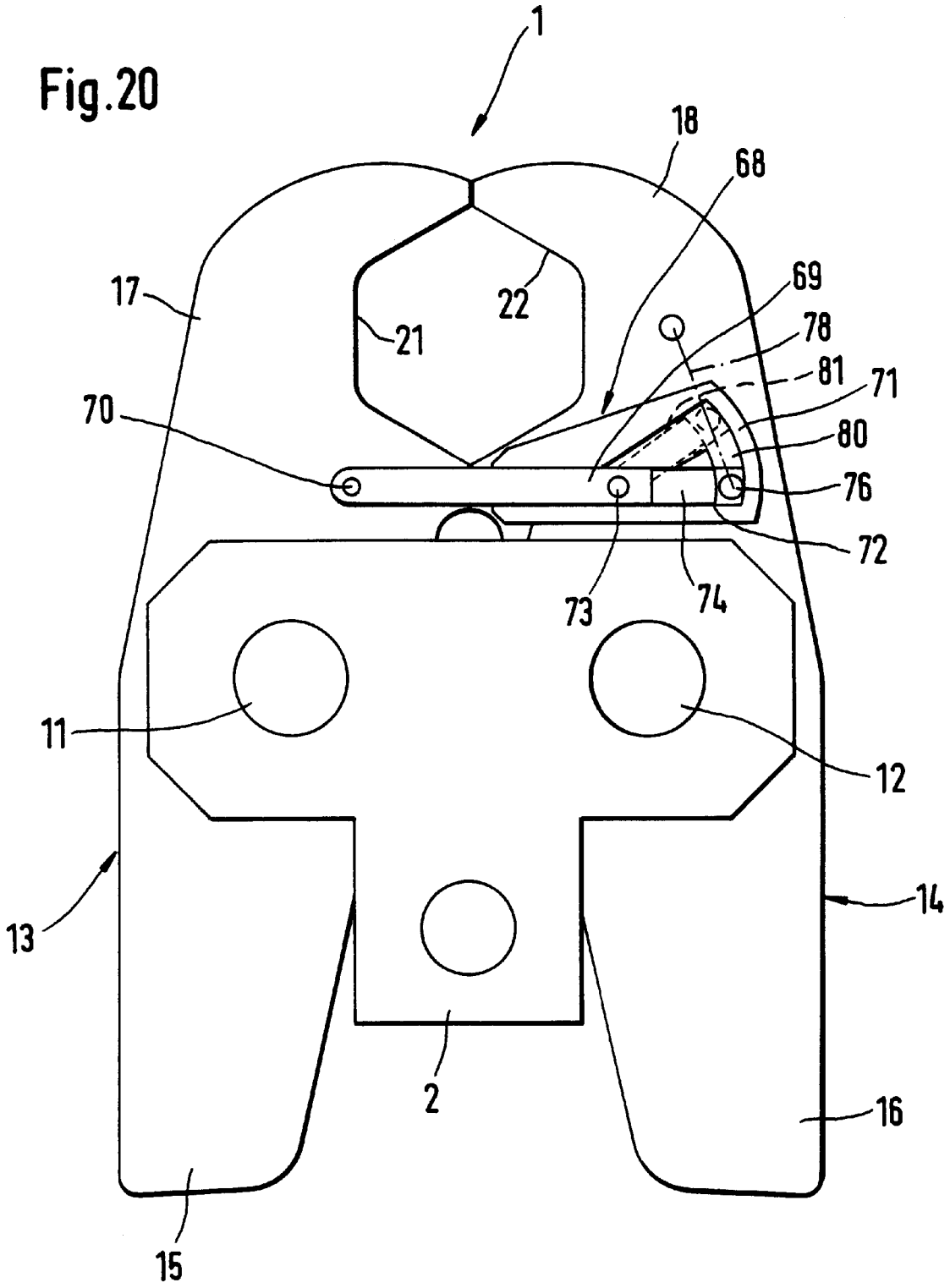
FIG. 20 shows a front view of the pressing device according to FIGS. 16 through 19, in the final pressed position.

In the open position (FIGS. 16 and 17), the free end of catch strut 69 is located in the inlet region of guideway 72. Catch tooth 75 thus rests on guideway 72 with a preload. Upon closure of pressing jaws 21, 22, catch strut 69 is pushed farther into lock housing 71. Despite the force proceeding from tension spring 78, catch 74 cannot enter return track 81 because the latter is not as deep as guideway 72, so that a step is formed in the connection from guideway 72 to return track 81. As pressing jaws 21, 22 approach closer, catch tooth 75 slides over catch step 79 (FIGS. 18 and 19). Catch step 79 then prevents pressing jaws 21, 22 from being brought back into the open position after an incomplete pressing in which pressing jaws 21, 22 did not reach the final pressed position. This is possible only after catch tooth 75 has been lifted by actuation pin 76 sufficiently far away from guideway 72 that it can be moved back over catch step 79. A manual intervention is thus required for this, giving the operator the certainty that a mispressing has occurred.

With pressing jaws 21, 22 in the final pressed position, catch 74 reaches the end of guideway 72. There it can pivot, under the tensile force of tension spring 78, into diversion track 80 (FIG. 20), and enters return track 81 (shown with dashed lines in FIG. 20). In this case pressing jaws 21, 22 can be opened without manual intervention; catch tooth 75 slides via return track 81 back into guideway 72, and after pressing jaws 21, 22 open, it once again reaches the position shown in FIGS. 16 and 17. After removal of pressing device 1, a further pressing operation can then be performed.

FIG. 21 shows a pressing device 1 having a different locking device 82 which bridges the gap between end faces 33, 34. Its more detailed configuration will first be explained with reference to FIGS. 22 and 23.

Locking device 82 has an elongated shaped part 83 which is pivotably suspended via a pivot pin 84 (FIG. 21) on right-hand jaw arm 18. In the direction of the opposing end face 33, shaped element 83 extends in a fork shape with two fork arms 85, 86 arranged at a distance from one another and running parallel, thereby bridging the gap between end faces 33, 34. Suspended on the left-hand jaw arm 17 via a pivot pin 87 is a clamping block 88 which fits into in the open space between fork arms 85, 86 in mutually guided fashion. A spring rod 89, which at the free end has a catch 90 directed toward shaped part 83, is clamped in clamping block 88. As the plan view shows, catch 90 is wider than spring rod 89.

In the right-hand region, shaped part 83 has a guide groove 91 corresponding to the width of catch 90. Mounted above guide groove 91 is a slider plate 92 which braces against shaped part 83, since it is wider than guide groove 91. It has a retaining flange 93 into which a stop screw 94 (depicted only in FIGS. 22 and 23), which extends horizontally, is threaded. It passes through an opening 95 in a stop web 96 which is part of shaped part 83. A stop nut 97 is located externally on stop screw 94. Said stop nut 97 limits the ability of slider plate 92 to move toward catch 90. Slider plate 92 is forced in that direction by two tension springs 98, 99.

Slider plate 90 has a T-shaped slot 100. In the region adjacent to retaining flange 93, said slot 100 is as wide as guide groove 91 and catch 90. In the region farther away from them, the width is reduced to slightly more than the width of spring rod 89, slot 100 continuing to the end of slider plate 92.

Located below slider plate 92 is an S-shaped leaf spring 101 which is secured to the bottom of guide groove 91 and rests under a preload against the underside of slider plate 92.

Figure 22:
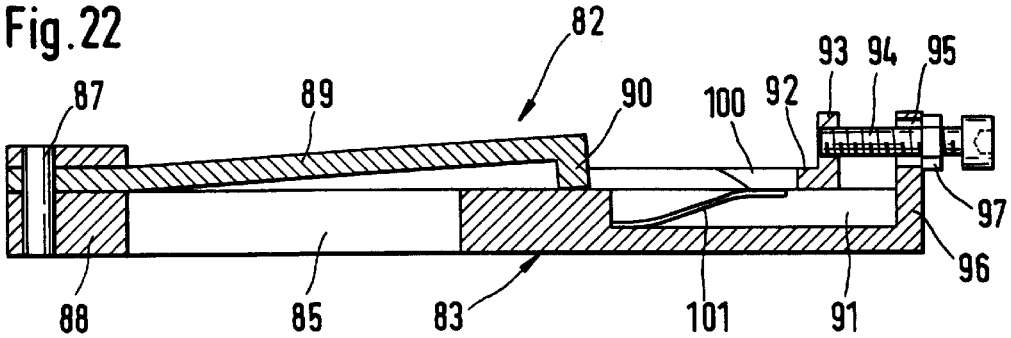
FIG. 22 shows a longitudinal section through the locking device according to FIG. 21, in the open position.
Figure 23:
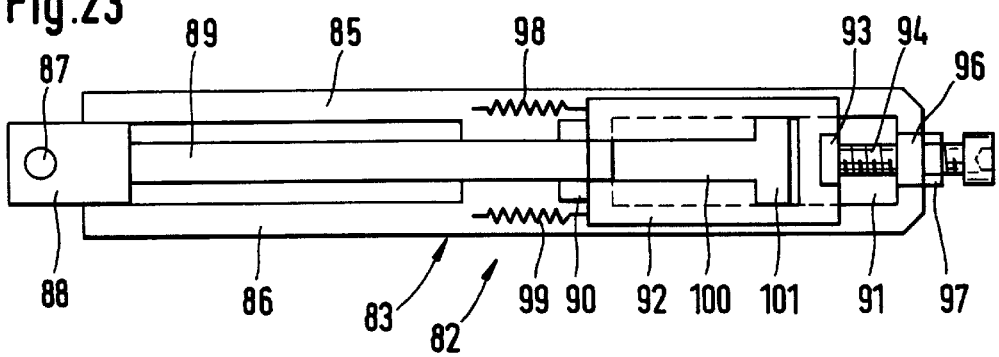
FIG. 23 shows a plan view of the locking device according to FIG. 22.
Figure 24:
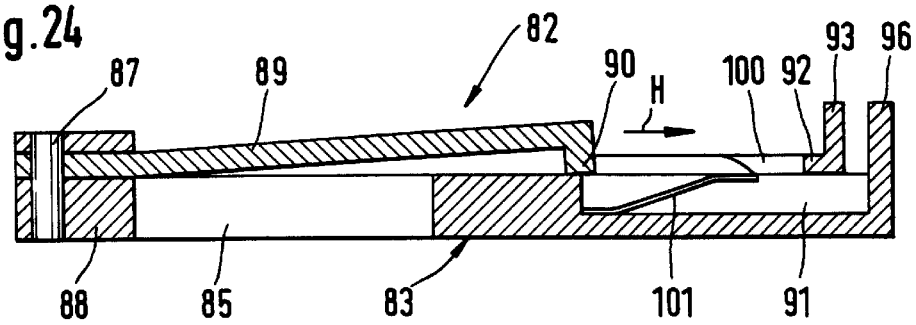
FIG. 24 shows a longitudinal section through the locking device according to FIGS. 21 through 23, after a first approach of the pressing jaws.
Figure 25:
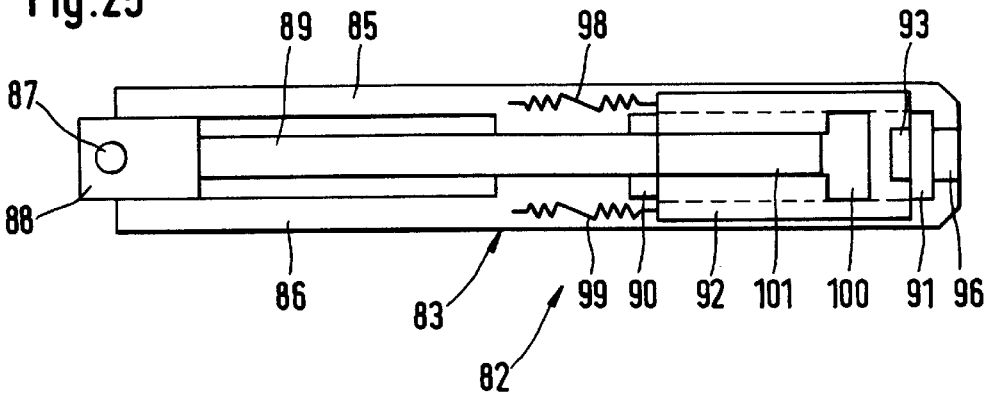
FIG. 25 shows the locking device according to FIG. 24 in a plan view.
Figure 26:
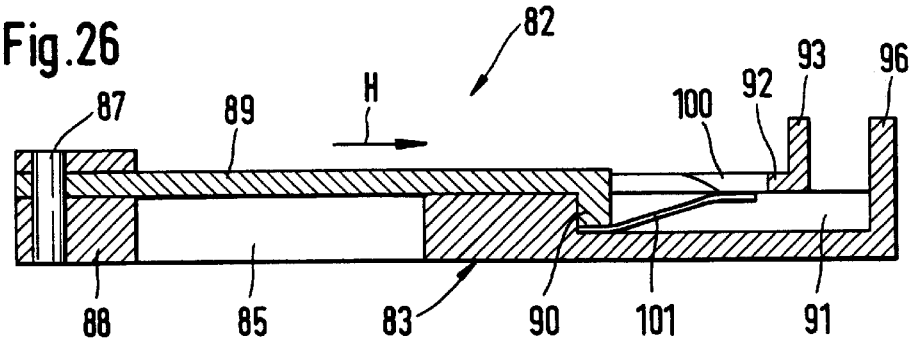
FIG. 26 shows the locking device according to FIGS. 21 through 25 in a longitudinal section, after a second approach of the pressing jaws.
Figure 27:
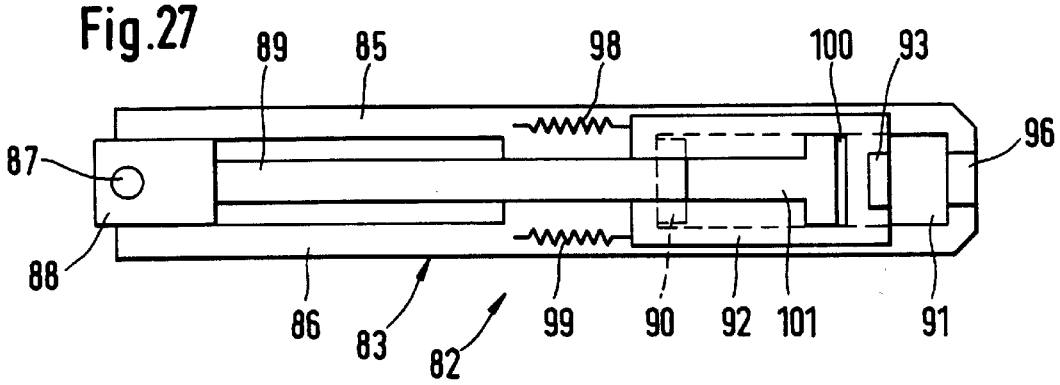
FIG. 27 shows the locking device according to FIG. 26 in a plan view.
Figure 28:
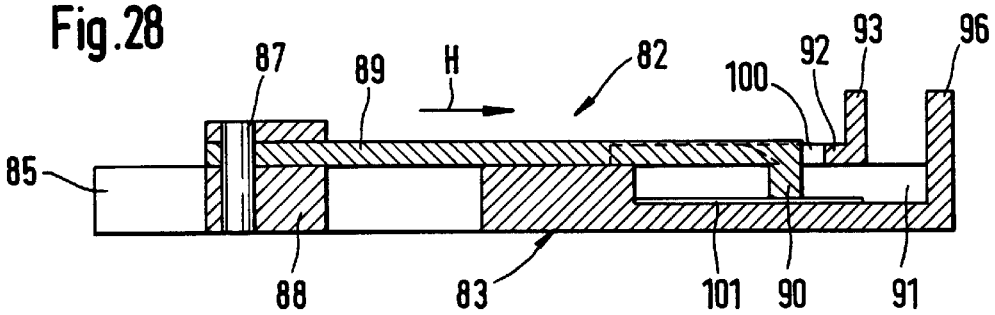
FIG. 28 shows the locking device according to FIGS. 21 through 27 in longitudinal section, after a third approach of the pressing jaws.
Figure 29:
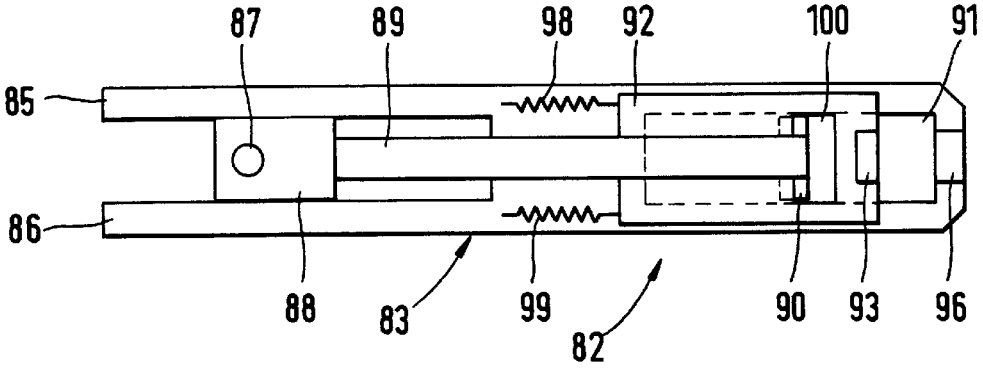
FIG. 29 shows a locking device according to FIG. 28 in a plan view.
Figure 30:
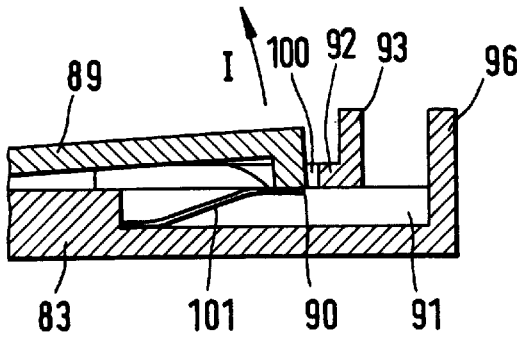
FIG. 30 shows a portion of the locking device according to FIGS. 21 through 29 in longitudinal section, after the final pressed position has been reached.

In the initial position with pressing jaws 21, 22 open, catch 90 is braced, under the preload of spring rod 89, against shaped part 83 (FIGS. 22 and 23). Slider plate 92 is in the position remote from stop web 96, stop nut 97 resting against stop web 96. As pressing jaws 21, 22 close, clamping block 88 and shaped part 83 slide within one another; catch 90 arrives against slider plate 92 and displaces it in the direction of arrow H (FIGS. 24 and 25). As pressing jaws 21, 22 close further, catch 90 slips over the edge of guide groove 91 located there, so that catch 90 fits completely into guide groove 91. Since all that is then located above shaped part 83 is spring rod 89, whose width is less than that of slot 90 in slider plate 92, slider plate 92 moves under the influence of tension springs 98, 99 back into its initial position (FIGS. 26 and 27). Catch 90 is then trapped in guide groove 91 by slider plate 92. As the operation continues, catch 90 is displaced in guide groove 91, thereby pushing leaf spring 101 downward onto the bottom of guide groove 91 (FIGS. 28 and 29), until catch 90 is located beneath the widened portion of slot 100. Since the width of slot 100 there is somewhat greater than that of catch 90, and since leaf spring 101 is stronger than spring rod 89, catch 90 is pivoted upward by leaf spring 101 (arrow I, FIGS. 30 and 31). In this context, the position of slider plate 92 is set, based on the adjustment using stop nut 97 (FIGS. 22 and 23), in such a way that catch 90 can be pushed upward through the widened section of slot 100 only if pressing jaws 21, 22 have reached their final pressed position.

Figure 32:
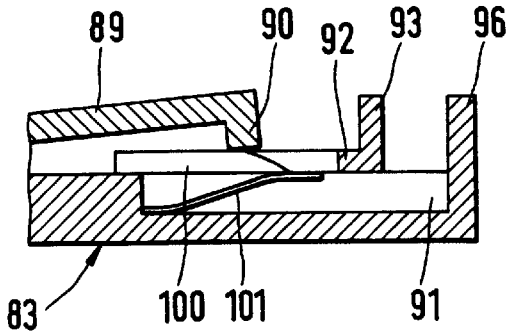
FIG. 32 shows a portion of the locking device according to FIGS. 21 through 31 in longitudinal section, after the pressing jaws have moved toward the open position.
Figure 33:
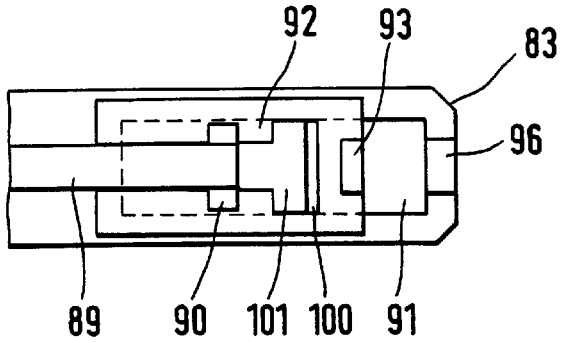
FIG. 33 shows a plan view of the locking device according to FIG. 32.

Pressing jaws 21, 22 can now be opened again; catch 90 slides onto the outer side of slider plate 92, assisted by bevels at the transition from the widened section of slot 100 into the narrowed section (FIGS. 32 and 33). When pressing jaws 21, 22 reach the open position, catch 90 slides back down away from slider plate 92, and then assumes the position evident from FIGS. 22 and 23. Another pressing operation can then be performed.

If an incomplete pressing occurs, catch 90 does not completely reach the widened section of slot 100 in slider plate 92. Pressing jaws 21, 22 can only be opened to the point where catch 90 strikes against the end of guide groove 91. The operator then knows that a mispressing has occurred. For complete opening of pressing device 1, slider plate 92 must then be removed.

Figure 34:
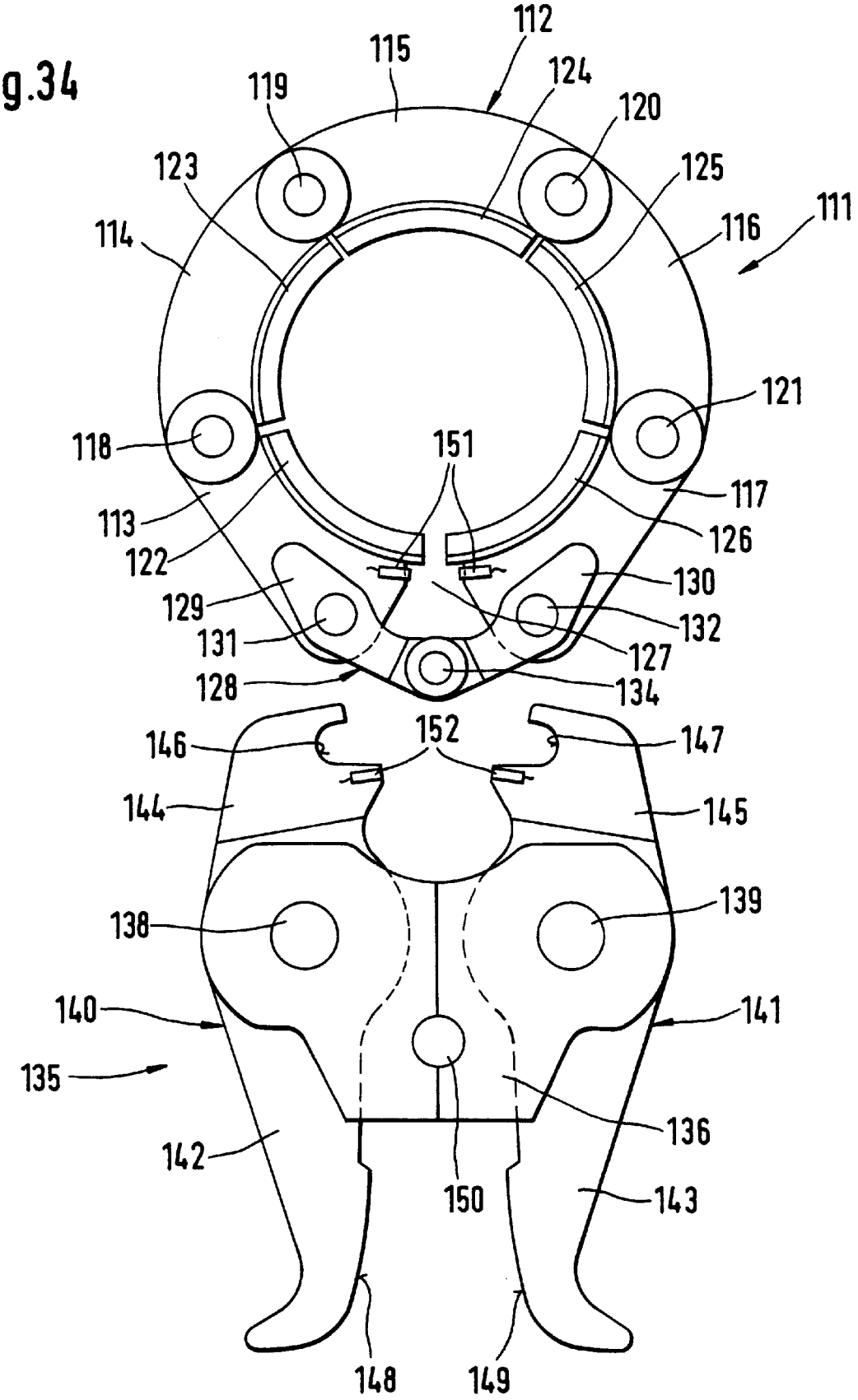
FIG. 34 shows a front view of a pressing device having a pressing ring and closing device.

Pressing device 111 depicted in FIG. 34 has as the pressing tool a pressing ring 112 that is constituted by five curved pressing jaw carriers 113, 114, 115, 116, 117. Pressing jaws 113 through 117 are joined to one another via articulating pins 118, 119, 120, 121, and carry a respective pressing jaw 122, 123, 124, 125, 126. Pressing jaws 122 through 126 are mounted, movably in the circumferential direction, on pressing jaw carriers 113 through 117.

A closure gap 127 is located between the two lower pressing jaw carriers 113, 117 and 122, 126. Closure gap 127 is bridged by a coupling device 128 which has two coupling tabs 129, 130, left-hand coupling tab 129 being arranged, via an articulating pin 131, at the free end of left-hand lower pressing jaw carrier 113, while right-hand coupling tab 130 is articulated at the free end of right-hand lower pressing jaw carrier 117. Coupling tabs 129, 130 are joined to one another in articulated fashion via a coupling pin 134. Coupling bolt 134 is removable, thus making it possible to open pressing ring 112 wide in the region of closure gap 127, so that it can be placed around a press fitting. After placement, the two coupling tabs 129, 130 are once again joined to one another so that pressing ring 112 can no longer drop down.

Associated with pressing ring 112 is a closing device 135 which is depicted only schematically here. Closing device 135 has two substantially T-shaped bearing plates 136, arranged at a distance behind one another, between which two closure levers 140, 141 are arranged pivotably by means of articulating pins 138, 139. Closure levers 140, 141 each have lower lever sections 142, 143 and upper lever sections 144, 145. Upper lever sections 144, 145 have recesses, oriented opposite to one another, as coupling elements. These are adapted to the articulating pins 131, 132 on which coupling tabs 129, 130 are articulated. Lower lever sections 142, 143 have drive surfaces 148, 149 oriented opposite to one another. A pair of rollers, which can be displaced vertically as part of a drive device (not depicted here) in the form of a hydraulic cylinder, can be introduced in known fashion into the space between drive surfaces 148, 149. For this, the drive device is suspended via a pin on bearing plates 136, 137, the pin being insertable into opening 150.

For a pressing operation, the two lower lever sections 142, 143 are brought together manually so that the two upper lever sections 144, 145 are spread apart. Closing device 135 can then be placed onto pressing ring 112 in such a way that recesses 146, 147 are located opposite articulating pins 131, 132. By moving the rollers into the initially narrow space between lower lever sections 142, 143, the latter are spread apart. Recesses 146, 147 thereby grasp articulating pins 131, 132 and bring them closer together. As a result, pressing ring 112 is drawn together, making closure gap 127 smaller so that the pressing space enclosed by pressing jaws 122 through 126 becomes smaller. This continues until the end faces of pressing jaws 122 through 126 come into mutual contact. In the process, the press fitting and the pipe end inserted into it are plastically deformed. To remove closing device 135 from pressing ring 112, the procedure is reversed.

A sensor 151 (depicted only symbolically) is attached in the region of closure gap 127 to the two opposing side of pressing jaw carrier 113, 117. Said sensor is adjusted so that in the defined final pressed position, its two opposing parts butt against one another and thereby generate an electrical signal which can then be used for an indication. By way of the indication, the user learns that the final pressed position has been reached. Instead of the arrangement on pressing ring 112, an arrangement on closing device 135 is also possible, specifically in the region of recesses 146, 147 in this case. This sensor 152 has the same function as sensor 151.

It is understood that the embodiments evident from FIGS. 5 through 15 are also possible for sensors 151, 152. They can also be combined with locking devices that are apparent from FIGS. 17 through 33.

What is claimed is:

1. A pressing device for joining a pipe with a press fitting, having:

at least two pressing jaws;

a drive for moving the pressing jaws from an open position into a final pressed position; and at least one locking device which, after the pressing operation has been initiated, prevents the pressing jaws from being opened back to the open position until the final pressed position has been reached, said at least one locking device being directly associated with the pressing jaws and separate from the drive so that any deformation or wear of the elements of the drive cannot cause said at least one locking device to activate before the final pressed position has been reached and cannot prevent said at least one locking device from activating when the final pressed position is reached.

2. The pressing device as defined in claim 1, wherein the locking device has an externally actuatable unlocking device.

3. The pressing device as defined in claim 2, wherein the unlocking device can be actuated only with a tool.

4. The pressing device as defined in claim 1, wherein the locking device(s) are respectively attached to two adjacent pressing jaws.

5. The pressing device as defined in claim 4, wherein the locking device(s) is or are respectively arranged in the region of two opposing end faces of pressing jaws.

6. The pressing device as defined in claim 1, wherein the locking device has on the one side a locking member and on the other side a guide device into which the locking member engages, the locking member and/or guide device having locking elements which constitute a return lockout acting only in the opening direction, and the guide device having a diverting device which the locking member reaches only if the pressing jaws are in the final pressed position, and which then deflects the locking member into a return track (81, 100) which bypasses the return lockout.

7. A pressing device for joining a pipe with a press fitting, having at least two pressing jaws and a drive for moving the pressing jaws or a part thereof relative to one another from an open position into a final pressed position, wherein at least one sensor for directly sensing the final pressed position of the pressing jaws is operatively associated with at least one of said pressing jaws so that said final pressed position is sensed directly from said at least one of said pressing jaws, said at least one sensor being adapted to sense said final pressed position in a manner that is independent of whether tips of said jaws are in abutment with one another; and an indicating device which generates an externally perceptible indicating signal when the final pressed position is or is not reached, is associated with the sensor.

8. The pressing device as defined in claim 7, wherein the indicating device generates a visually perceptible indicating signal.

9. The pressing device as defined in claim 8, wherein the sensor has a feeler which generates an electrical signal, and the indicating device has a lamp which is electrically connected to the feeler.

10. The pressing device as defined in claim 7, wherein the indicating device has a mechanical indicating member.

11. The pressing device as defined in claim 7, wherein the indicating device has an indicating memory which maintains the indicating signal even after the pressing jaws have moved toward the open position, the indicating memory having an externally actuatable canceling device.

12. The pressing device as defined in claim 11, wherein the canceling device has an actuation lock which can be overridden only with a tool.

13. The pressing device as defined in claim 7, wherein the sensor or at least one of the sensors is arranged in the region of one pressing jaw in such a way that it senses the position of that pressing jaw with respect to an adjacent pressing jaw.

14. The pressing device as defined in claim 7, wherein the sensor or at least one of the sensors is arranged in the region of two adjacent pressing jaws in such a way that it senses the position of those pressing jaws relative to one another.

15. The pressing device as defined in claim 7, wherein the sensor or sensors is or are arranged in the region of the opposing end faces of two adjacent pressing jaws.

16. The pressing device as defined in claim 13, wherein all pairs of opposing end faces each have a respective sensor associated with them.

17. The pressing device as defined in claim 7, wherein multiple sensors are provided which emit a signal only if all the sensors have sensed a final pressed position.

18. The pressing device as defined in claim 7, wherein the pressing jaws sit on a pressing ring which has, in the region of an open closure point, coupling elements for the engagement of corresponding coupling elements by means of which the coupling elements on the pressing ring side can be moved together to close the pressing ring, the sensor or at least one of the sensors being arranged in the region of the closure point and/or of the coupling elements on the closing device side.

19. The pressing device as defined in claim 7, wherein the sensor respectively has a movably mounted feeler (37, 55, 64) which coacts with a stop against which the feeler arrives as the pressing jaws are closed.

20. The pressing device as defined in claim 19, wherein the feeler is attached to one pressing jaw and the stop to the adjacent pressing jaw.

21. The pressing device as defined in claim 17, wherein the stop is adjustable in the movement direction of the feeler.

22. The pressing device as defined in claim 17, wherein the feeler is coupled to a sensor which senses the positional change of the feeler.

23. The pressing device as defined in claim 20, wherein the sensor is arranged outside the pressing jaws.

24. A pressing device, in particular for joining a pipe, having at least two pressing jaws and a drive for moving the pressing jaws from an open position into a final pressed position, wherein:

at least one sensor for sensing the final pressed position of the pressing jaws, is operatively associated with at least one of said pressing jaws so that said final pressed position is sensed directly from said at least one of said pressing jaws; and the sensor is coupled to the drive in such a way that the drive is automatically switched off by means of a shutdown device upon the final pressed position being reached.

25. A pressing device, in particular for joining a pipe, having at least two pressing jaws and a drive for moving the pressing jaws from an open position into a final pressed position, wherein:

at least one sensor for sensing the final pressed position of the pressing jaws, is operatively associated with at least one of said pressing jaws so that said final pressed position is sensed directly from said at least one of said pressing, jaws; and the sensor is coupled to the drive via a locking device that prevents the drive from being activated, when it has been switched off during a pressing operation, unless the sensor or sensors has or have sensed the final pressed position.

26. The pressing device as defined in claim 25, wherein the locking device has an externally actuatable unlocking device.

27. The pressing device as defined in claim 26, wherein the unlocking device can be actuated only with a tool.

28. A pressing device for joining a pipe with a press fitting, comprising:

at least two pressing jaws;

a drive for moving the pressing jaws or a part thereof relative to one another from an open position into a final pressed position;

at least one sensor arranged on at least one of said pressing jaws, for mechanically sensing the final pressed position of the pressing jaws; and a mechanical indicating device mechanically responsive to said at least one sensor and adapted to generate an externally perceptible indicating signal that indicates whether the final pressed position is reached.

* * * * *